US010280030B2

(12) United States Patent
Hummel

(10) Patent No.: US 10,280,030 B2
(45) Date of Patent: May 7, 2019

(54) FABRIC ORGANIZATION DEVICE

(71) Applicant: Sew Innovative, Inc., Livermore, CA (US)

(72) Inventor: Elizabeth Ellen Hummel, Livermore, CA (US)

( * ) Notice: Subject to any disclaimer, the term of this patent is extended or adjusted under 35 U.S.C. 154(b) by 35 days.

(21) Appl. No.: 15/630,148

(22) Filed: Jun. 22, 2017

(65) Prior Publication Data

US 2018/0009626 A1 Jan. 11, 2018

Related U.S. Application Data

(60) Provisional application No. 62/358,694, filed on Jul. 6, 2016.

(51) Int. Cl.

| | |
|---|---|
| ***B65H 45/20*** | (2006.01) |
| ***B65H 75/06*** | (2006.01) |
| ***B65H 75/24*** | (2006.01) |
| ***B65H 75/26*** | (2006.01) |

(52) U.S. Cl.

CPC ..... *B65H 45/20* (2013.01); *B65H 75/06* (2013.01); *B65H 75/24* (2013.01); *B65H 75/26* (2013.01); *B65H 2701/534* (2013.01)

(58) Field of Classification Search

CPC .... B65D 85/67; B65D 85/671; B65D 85/672; B65D 85/675; B65D 85/676; B65D 85/677; B65H 45/20; B65H 75/06; B65H 75/24; B65H 75/26; B65H 2701/534; B32B 3/06

USPC ..... 206/388, 390, 472–475, 820; 223/109 R

See application file for complete search history.

(56) References Cited

U.S. PATENT DOCUMENTS

| | | | | |
|---|---|---|---|---|
| 3,768,640 | A | 10/1973 | Piscatelli | |
| 3,780,855 | A | 12/1973 | McLeod et al. | |
| 3,825,463 | A * | 7/1974 | Amann | B32B 38/0004 156/268 |
| 4,126,285 | A | 11/1978 | Spruill | |
| 4,129,212 | A | 12/1978 | Hopkins | |
| 4,258,843 | A | 3/1981 | Wymer | |
| 5,335,872 | A | 8/1994 | Clubbs | |
| 6,630,223 | B2 * | 10/2003 | Hansen | B29C 53/78 162/358.2 |
| 7,255,299 | B2 | 8/2007 | Braun | |
| 7,811,649 | B2 * | 10/2010 | Post | A47L 13/20 206/820 |
| 7,992,712 | B2 | 8/2011 | Rosland | |
| 2006/0243841 | A1 | 11/2006 | Herrod | |
| 2007/0151875 | A1 | 7/2007 | Morrissey et al. | |
| 2013/0084413 | A1 * | 4/2013 | McMahan | B32B 5/18 428/33 |

* cited by examiner

*Primary Examiner* — Bryon P Gehman

(74) *Attorney, Agent, or Firm* — Michael Petrin; Antero, Tormey & Petrin

(57) ABSTRACT

The invention relates to a fabric organization device for collecting, gathering, folding, organizing, stacking and storing sheets of flexible materials including fabrics, textiles, and other flat, sheet-form, bendable, flexible and foldable woven, non-woven and textile materials, embodiments of the invention enabling pieces and sheets of materials to be collected in an organized, uniform and stackable manner to facilitate the display, handling and storage of textile materials in a convenient and economical manner.

20 Claims, 10 Drawing Sheets

Side View

Side View

Side View

Side View

FABRIC ORGANIZATION DEVICE

REFERENCES

The present application claims the priority of U.S. provisional application No. 62/358,694, filed on Jul. 6, 2016, which is also incorporated herein by reference in its entirety.

FIELD

The disclosed embodiments of the current disclosure relate generally to a fabric organization device for collecting, folding, storing and stacking sheets of flexible materials.

BACKGROUND

Various approaches for collecting sheets of flexible materials exist including simple rods and tubes for collecting and rolling suitable materials, such as cloth or fabric pieces, along the length of these cylindrically-shaped support structures. Pieces or "bolts" of fabric are collected in such fashion, rolls of which can be stacked on shelves or positioned upright in bins for storage. Unless the material is folded prior to loading, adequate support requires a support length equal to and preferably slightly longer (so that no fabric protrudes beyond the edge and thus potentially subject to abrasion and soiling) in length than the smallest dimension of the material to be placed onto the support. Hence, most rolls or "bolts" are long, as typical fabric widths may include 35-36" (inches), 39", 41", 44-45", 50", 52-54", 58-60" and 66", 72", 96", and 108" and other custom widths as well (Source: Wikipedia: #Bolt(Fabric), page updated 2016).

Other approaches include flattening the support structures or shaping them to be flattened with elliptical and/or ovoidal cross sections, enabling them to collect and roll the materials and yet further facilitate stacking of a plurality of the somewhat flattened rolls. However, the length of these flat rolls are equally as long as the minimum width of the fabric, making storage difficult owing to the lengths involved, which usually exceed standard shelf depths in homes and retail stores, which are typically of 24 to 30" in depth. Accordingly, collected fabrics on rolls are usually stored on customized shelving deep enough to fit the length of the roll, which adds expense to storage and display. Alternatively, rolls can be stored and presented vertically by stacking in bins, but this provides disorganized storage and results in soiling of the lower portion of the collected fabric materials on the roll resulting from dust and debris that collects in the open bins, and the effects of abrasion on the ends or sides of the rolls coming into contact with the bins, which are generally constructed of either wood or wire cage to hold a plurality of fabric rolls. Accordingly, the use of conventional means for storing fabric results in somewhat cumbersome shelving and storage requirements requiring deep shelving or open, disorganized bins for storing and presenting rolled fabrics in home, retail and commercial environments.

While fabric can be pre-folded to reduce its width-on-roll, these pre-folds are sharp 180 degree folds in the material itself, involving the folding of the material back onto itself, and is generally done in a direction parallel to the bias (running thread or length) of the material, which if being a woven, partially woven or other such biased, oriented material, will result in the undesirable creasing of the material along the sharp fold. While subsequent creases can be removed or reduced later, this requires a second step such as application of heat or steam via ironing, steaming, pressing, or the like, to effectively remove the crease.

Accordingly, there is a need for a device that is low cost, simple to use and which enables the convenient collection and storage of fabrics and similar textile materials in a compact and easily stacked or organized fashion that provides an improvement over conventional means that have not been improved over historical times.

SUMMARY

In one aspect of the current disclosure is a fabric organization device for receiving and organizing sheet materials comprising: (a) a plurality of hingedly connected panel sections comprising a first and a second panel component; wherein said panel components are substantially flat and rigid planar segments each having a length at least greater than their respective width; (b) at least one central hinge section; wherein a first edge of said hinge section is hingedly connected to a first edge of said first panel component, and wherein an opposed second edge of said hinge section is hingedly connected to a second edge of said second panel component; wherein said hinge section is flexible and substantially articulable only in a traverse and perpendicular direction with respect to a longitudinal plane passing through said first and said second panel components when said first and second panel components are positioned in a substantially planar and unfolded first configuration; and wherein said hinge section is configured to enable said first and said second panel components to be repositioned with respect to one another so as to enable their articulation between said substantially planar and unfolded first configuration to a substantially parallel and coplanar folded second configuration by means of folding said hinge section upon itself in a traverse and perpendicular direction with respect to said longitudinal plane until said first and second panel components are brought into said second configuration.

In a related aspect of the current disclosure is a fabric organizational device disclosed above further comprising one or a plurality of bore holes located near the distal end of at least one of said panel components; wherein said plurality of bore holes, if present, are located near the distal ends of both panel components in a position selected so that at least two of the plurality of bore holes are brought into a position of co-alignment when said folding device is positioned into a folded orientation as disclosed; and wherein said bore holes are not contiguous to any edge or end of said panel components.

In a further related aspect of the current disclosure is a fabric organizational device as disclosed further comprising one or a plurality of cutout features with void spaces having shapes selected from grooves, slits, lines, zig-zag, U-shaped, V-shaped, W-shaped, Z-shaped and the like; wherein at least one portion of said void space of said shape is contiguous with and coincidental to at least one outer side edge of at least one of said panel components; and wherein said cutout features is configured to receive or secure a corner or segment of a flexible sheet material to the surface of said panel component.

In another aspect of the current disclosure is a fabric organizational device as disclosed further comprising one or a plurality of anti-slip elements; wherein said anti-slip element is formed into (for example a textured manufactured board) or located on at least one surface or at least one edge of at least one panel component (for example an added element or embossed feature); wherein said anti-slip element is selected to frictionally engage with flexible sheet material to be collected onto said device; wherein said anti-slip element is in a form selected from raised dots, raised bars, raised squares, raised chevrons, raised lines and raised geometric patterns, including continuous and discontinuous patterns thereof, of a suitable frictional material formed onto or attached to at least one surface or at least one edge of said panel component; and wherein said frictional material is selected from antiskid tapes, friction tapes, sandpaper, textured tapes and laminates, tacky silicone resins, sticky polymers, combinations thereof, and the like.

In related aspects of the current disclosure is a fabric organizational device as disclosed further comprising one or a plurality of magnetic clasp units; wherein said magnetic clasp unit comprises a combination of elements selected from a magnet, ferro-magnetic material, iron keeper, or the like; and wherein at least one first element of said magnetic clasp unit is located on a least one front, back or intermediate surface of at least one panel component and wherein at least second element of said magnetic clasp unit is located on a corresponding surface and at a complimentary position on said corresponding surface of said second panel component so that said first and second element of said magnetic clasp unit is brought into close proximity or contact when said folding device is positioned into a folded, compact configuration in which the elements of the corresponding magnetic clasp unit become engaged magnetically.

In yet another related aspect of the current disclosure is a fabric organizational device as disclosed further comprising one or a plurality of cutout features with a first void space comprising a slotted hole; wherein said slotted hole is contiguous with at least one panel opening located at one distal edge of said first panel component so as to provide a means for hanging said folding tool onto a support structure selected from a rod, pole, line or the like, by means of passing said support structure through said panel opening then through said slotted hole to engage said support structure when said folding tool is suspended in a vertical position from said support structure; wherein said folding tool optionally comprises a second void space comprising a second slotted hole, similarly configured and correspondingly positioned at the opposite edge of said second panel with respect to said distal edge of said first panel component so that when said folding tool is folded from an extended planar configuration to a compact folded configuration the first and second void spaces are brought into a co-aligned and parallel orientation enabling both said first and second slotted holes to simultaneously engage said support structure; so that said folding tool may be suspended in a vertical position from said support structure when said folding tool is in a compact, folded configuration.

In one additional aspect of the current disclosure is a fabric organizational device as disclosed wherein said first and a second panel component comprise a substantially rigid material selected from paperboard, cardstock, cardboard, foam core, plastic, polymer, honeycombed material, metal and combinations thereof; and wherein said paperboard is selected from ISO paper weight ranges (in grams per square meter or "gsm") corresponding to about 70 to 100 gsm (medium textweight), or alternatively from 100 to 120 gsm (heavy textweight or light cardstock), or alternatively from 120 to 150 gsm (regular cardstock), or alternatively from 150 to 200 gsm (heavy cardstock), or alternatively greater than about 200 gsm (super heavy cardstock) up to 500 gsm (heavy cardboard), and combinations thereof; and optionally said paperboard is constructed of acid-free materials suitable for extended contact with said sheet materials as disclosed herein.

In a related aspect of the current disclosure is a fabric organizational device as disclosed in which said flexible hinge section and said panel components are constructed of a polymer selected from, but not limited to, polyacrylate, polymethacrylate, poly(alkyl)acrylates, acetobutylstyrene, Nylon (6,6), polylactic acid, polybenzimidazole, polycarbonate, polyether sulfone, polyetherether ketone, polyetherimide, polyethylene, polyphenylene oxide, polyphenylene sulfide, polybutylene, polypropylene, polystyrene, polyvinyl chloride, polyvinylidene chloride, perfluoropolymers, Telfon™, silicones, siloxanes, polysilicones; and copolymers thereof; co-mixtures thereof; and other thermoplastic polymers and copolymers with similar chemical and physical properties providing inertness to environmental conditions including heat and humidity. In various embodiments of the disclosure, any plastic or polymer components can be constructed using cast, machined, molded, injection molded and/or 3-dimensionally printed or formed materials, and combinations thereof.

In an alternative related aspect of the current disclosure is a fabric organizational device as disclosed wherein the flexible hinge section is constructed of a flexible material selected from paperboard, cardstock, cardboard, foam core, plastic, polymer, honeycombed material, metal and combinations thereof.

In another related aspect of the current disclosure is a fabric organizational device as disclosed wherein the flexible hinge section is constructed of a common material as the material of construction of said first and second panel component; wherein said common material is contiguous between said hinge section and said panel components; and wherein the thickness of said common material in the hinge section is less than the thickness of said common material in either of said first or second panel components.

In yet another related aspect of the current disclosure is a fabric organizational device as disclosed wherein the flexible hinge section is constructed of a single laminate layer that overlaps at least a portion of said first and second panel components; said portion being the respective proximate ends of each panel component in contact with said flexible hinge section, the length of said portions of said laminate layer being sufficient to secure the laminate to said first and second panel components and thereby sufficient to secure said first and second panel components in an aligned and co-linear configuration with the spacing between the respective panel components forming a single layer laminate hinge region.

In an alternative aspect of the current disclosure is a fabric organizational device as disclosed wherein the flexible hinge section is constructed of at least two opposed laminate layers that each overlap at least a portion of one side of said first and second panel components, and the corresponding second side; said portion being the respective proximate ends of each panel component in contact with said flexible hinge section, the length of said portions of said laminate layers being sufficient to secure the laminate to a first and second side of said first and second panel components and thereby sufficient to secure said first and second panel components in an aligned and co-linear configuration with the spacing between the respective panel components forming a dual layer laminate hinge region; and wherein optionally, at least one side of at least one of said panel components bears imprinted or printed indicia; wherein said indicia is selected from alignment marks, lines, dots, grid marks, and the like.

In a further related aspect of the current disclosure is a fabric organizational device as disclosed further comprising one or a plurality of fastening means positioned on at least one surface of said first or second panel component; wherein said fastener means operates to reversibly secure an edge or a corner of a sheet material to assist in holding said sheet material in a fixed position relative to said panel component; and wherein said fastener means comprises fasteners selected from clips, darts, fabric corners, pins, adhesive elements such as tacky dots and the like, magnets and ferromagnetic objects, and combinations thereof.

In one aspect of the current disclosure is a fabric organizational device that can receive and hold flexible sheet materials selected from fabrics, yarns, upholstery materials, foam sheets, laminated foams, laminated fabrics, knits, weaves, woven sheet materials, quilts, bedsheets, sheets, fabric samples, rugs, swatches, swags, spreads, non-woven sheet materials, patterns, templates, towels, wraps, and other flat-form, bendable, flexible and foldable woven and non-woven textile materials, and combinations thereof.

In a further related aspect of the current disclosure is a fabric organizational device for receiving and organizing sheet materials comprising: (a) a plurality of hingedly connected panel sections comprising a first and a second panel component; wherein said panel components are substantially flat and rigid planar segments each having a length at least greater than their respective width; wherein said panel components have the same size with respect to width, length and thickness; (b) at least one central hinge section; wherein a first edge of said hinge section is hingedly connected to a first edge of said first panel component, and wherein an opposed second edge of said hinge section is hingedly connected to a second edge of said second panel component; wherein said hinge section is flexible and substantially articulable only in a traverse and perpendicular direction with respect to a longitudinal plane passing through said first and said second panel components when said first and second panel components are positioned in a substantially planar and unfolded first configuration; wherein said hinge section is configured to enable said first and said second panel components to be repositioned with respect to one another so as to enable their articulation between said substantially planar and unfolded first configuration to a substantially parallel and coplanar folded second configuration by means of folding said hinge section upon itself in a traverse and perpendicular direction with respect to said longitudinal plane until said first and second panel components are brought into said second configuration; and wherein the width of said hinge section is less than or equal to the width of either of said first or second panel components.

In a related aspect of the current disclosure is a fabric organizational device as disclosed comprising: (a) a plurality of hingedly connected panel sections comprising a first and a second panel component; wherein said panel components are substantially flat and rigid planar segments each having a length at least greater than their respective width; (b) a central hinge section; wherein said central hinge section comprises a laminated structure comprising at least one laminate film; wherein said laminate film is laminated to at least a portion of each of said first and second panel components; wherein said first and second panel components are positioned end to end in a longitudinal orientation with a space between occupied only by said laminate film; wherein said hinge section is flexible and substantially articulable only in a traverse and perpendicular direction with respect to a longitudinal plane passing through said first and said second panel components when said first and second panel components are positioned in a substantially planar and unfolded first configuration; and wherein said hinge section is configured to enable said first and said second panel components to be repositioned with respect to one another so as to enable their articulation between said substantially planar and unfolded first configuration to a substantially parallel and coplanar folded second configuration by means of folding said hinge section upon itself in a traverse and perpendicular direction with respect to said longitudinal plane until said first and second panel components are brought into said second configuration.

In yet another related aspect of the current disclosure is a fabric organizational device as disclosed wherein said central hinge section comprises a dual laminated structure comprising a first and second laminate films; wherein said first laminate film is laminated to a least a portion of each of said first and second panel components; wherein said second laminate film is laminated to a least an opposed portion of each of said first and second panel components; wherein said opposed portion is present on the opposite side of said panel components bearing said first laminate film; wherein said first and second panel components are positioned end to end in a longitudinal orientation with a space between occupied only by said first and second laminate film; and wherein said central hinge section is formed by means of a dual laminated structure comprising a laminate-to-laminate joinder region without any intervening panel component in between said first and second laminate films.

The various advantages of these aspects of the current disclosure will become more apparent with a fuller and more detailed description of the features and functions of various embodiments of the disclosed fabric organizational device that follow.

BRIEF DESCRIPTION OF THE DRAWINGS

The above and/or other aspects and advantages of the current disclosure will become more apparent and more readily appreciated from the following detailed description of the disclosed embodiments taken in conjunction with the accompanying drawings of which.

Figure 1:
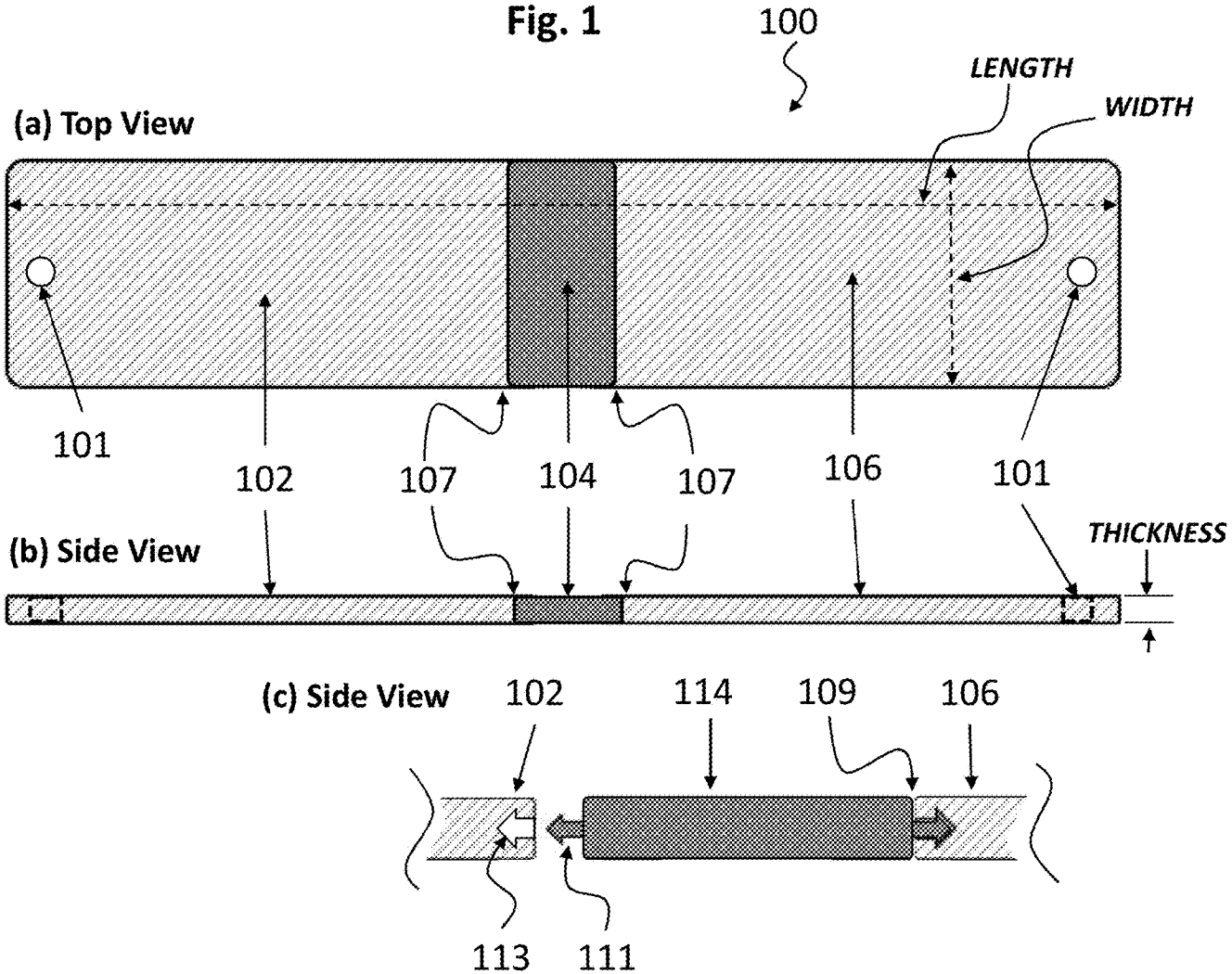
FIG. 1 shows one embodiment of the current disclosure featuring a folding tool with a flexible hinge section.

A corresponding Key detailing the specific component parts, regions and means of the various embodiments of the current disclosure accompany each of the above Figures.

DESCRIPTION

Generality of Invention

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to contemplated causes and effects for some implementations do not preclude other causes or effects that might occur in other implementations, nor other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention. References to reasons for using particular techniques do not preclude these variations or those that would become clear to those skilled in the art after perusal of this application.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Read this application with the following terms and phrases in their most general form. The general meaning of each of these terms or phrases is illustrative, not in any way limiting.

Detailed Description

Multiple embodiments of the current disclosure are described in greater detail below, illustrating various approaches, configurations, materials of construction and means for making and using embodiments of the invention.

FIG. 1 shows one embodiment of the current disclosure featuring a folding tool 100 with a flexible hinge section 104 located approximately at the longitudinal midpoint of the tool 100, wherein a first edge of the flexible hinge section 104 is attached to, connected with or joined with one side of a first panel component 102 and wherein a second edge of the flexible hinge section 104 is similarly attached to, connected with or joined with a second panel component 106. In this and following embodiments of the current disclosure, the panel components are substantially flat and planar in form, and have the desired characteristic of being relatively stiff and sufficiently rigid so as not to bend or deform substantially under their own weight, and constructed of materials as disclosed herein below.

In contrast to the panel components, the flexible hinge sections of the various embodiments of the invention are preferably sufficiently flexible so as to be able to bend approximately 180 degrees over the length or width of the flexible hinge section, i.e., in preferred embodiments the flexible hinge sections are capable of bending over onto themselves sufficiently so as to enable, for example, the first panel component 104 and second panel component 106 of the embodiment shown in FIG. 1 (extended position with 0 degree fold) to fold upon itself so that the two panel components are essentially parallel and co-planar in orientation to one another, the optional holes 101 then being aligned and coincident with one another (folded position with an approximate 180 degree fold), being foldable, optionally, in either direction.

In further embodiments of the current disclosure, the flexible hinge section is selected from materials that are relatively flexible in nature, or which have been formed, configured, treated, or physically manipulated to be rendered flexible. In one embodiment of the current disclosure, the flexible hinge section is constructed of the same material as the first and second panel components, for example, but not limited to a heavy duty cardstock of sufficient thickness to be relatively stiff and sufficiently rigid that the first and second panel components are self-supporting without significant bending, and in contrast, the region of the inventive device corresponding to the flexible hinge section has been physically manipulated by multiply folding, bending or creasing the material within this region in alternating up and down or repeating V or W folded pattern that renders that section into a flexible hinge section. In this and related embodiments of the current disclosure, the entire folding tool is constructed of the same common material to the first and second panel components and the flexible hinge section, the latter section of the current disclosure having been secondarily processed as described herein to render that region flexible and articulable with respect to the first and second panel components.

In other embodiments of the current disclosure, the flexible hinge section may be constructed of a different material than that of the first and second panel components, and then attached, bonded, connected, conformed, joined, glued or in some manner conjoined with a first and second panel component, joined each to one side of the flexible hinge section so as to form a folding tool in which the three sections are coplanar with respect to one another when positioned in an unfolded or extended and flat configuration, with approximately similar outer dimensions of width and thickness, such that the top and bottom surfaces are essentially flat and coplanar, and the outer edge is relatively smooth and free from large gaps or spaces. In other related embodiments of the current disclosure however, the width and thickness of the flexible hinge section may each independently be smaller in dimension than that same corresponding dimension of either of the first or second panel component, e.g. not as thick as the thickness of the panel components, or alternatively, and/or simultaneously, not as wide as the width of the panel components. In other embodiments, the hinge section may be constructed using a conventional hinge, such as a door, panel or piano hinge having a removable or non-removable hinge pin or pin rod connecting two sides of the hinge, which are then attached by some means to one or more respective panel components to produce one or more hingedly connected planar panel sections as disclosed herein.

Regarding FIG. 1, in this particular embodiment of the current disclosure, one or a plurality of holes 101 are optional, and provide a convenient means for hanging the folding tool 100 upon a peg or screw or similar hanging means, or able to support the extended folding tool 100 in the configuration shown in FIG. 1(*a*) or in a folded position (not shown) in which the first panel component 102 and second panel component 106 are brought into planar contact when the tool is folded about the center flexible hinge 104, which then results in the first hole 101 in panel 102 becoming co-aligned with the second hole 101 in panel 106, providing a convenient means for hanging the folded tool by means of said peg or screw passing between both holes 101 to support the folding tool 100 in a vertically hanging position supported by said hanging means. This provides a convenient means for displaying and storing one or a plurality of folding tools 100 at home, in stores or retail shelving units, by means of hanging one or more of the folding tools 100 on a single hook or screw using one or more of the holes 101 to support and display one or a plurality of folded configurations of the folding tool 100.

FIG. 1(*b*) shows a side view of one embodiment of the current disclosure in which the flexible hinge section 104 is of similar width and thickness dimensions as those of the first and second panel components 102 and 106 and is also of similar thickness, respectively, being joined in some suitable manner, for example, but not limited to, an adhesive bond or glue fastening to non-reversibly attach and fix the flexible hinge section in position between the first and second panel components.

FIG. 1(*c*) shows a partial, exploded side view of another embodiment of the current disclosure in which the flexible hinge section 104 has tongues, or pins, or fingers or other similar protrusions along one or both contacting surfaces (here, inner edges in contact with said first and second panel components 102 and 106) that engage with, interlock with or otherwise attach to corresponding grooves, bores or channels or other similar cutouts configured to be receptive to said tongues, pins, fingers or other protrusions on said flexible hinge section 114. In the embodiment exampled in 1(*c*), a tongue 111 located along the connecting surfaces of the flexible panel 114 extends outward and functions to engage with a corresponding groove 113 located on the contacting edges of the first and second panel components 102 and 106, to form a panel-to-panel tongue and groove junction 109. In this embodiment, the groove 113 located along the edge of panel 102 has a correspondingly negative recessed profile with respect to the protruding tongue 111 located along the edge of panel 114 so that when the tongue 111 and groove 113 elements are brought together, they function to interlock with one another to form at least a semi-permanent link or attachment. In a further embodiment, the folding tool 100 illustrated in FIG. 1(*c*) could further be augmented by applying some suitable adhesive to the tongue and groove elements, 111 and 113 respectively, prior to or during initial engagement in order to more permanently fix the junction and hold the three component elements of the folding tool together.

Other suitable embodiments of the current disclosure include a folding tool 100 selected using a material that is either substantially hollow with a plurality of void spaces or made with a material having a plurality of holes resembling hole 101 for the purpose of reducing the amount of physical material needed to construct the panel components, provided that the nature of the material selected for the panel components is maintained sufficiently flat and sufficiently rigid so that the panel components do not bend substantially despite having a plurality of void spaces or holes present. In these embodiments, the void spaces and holes can be selected from any suitable shape, including, but not limited to circles, triangles, squares, other geometric shapes, or closed shapes, and the holes can be any number from 1 to a plurality. In embodiments of the current disclosure featuring the use of a material that is substantially hollow for one or both of the panel components, the material can be selected from, but not limited to, corrugated board, cardboard and other paper boards that feature an internal honeycomb or baffle spacer laminated by two outer continuous planar sheets of paper, and the like. In related embodiments, the panel components can be constructed from materials capable of being formed into a honeycombed structure as described above using any suitable process, such materials including, but not limited to, wood fiber, wood pulp, compressed wood, plastics, polymers, thermoset resins, rubber, silicones, and the like.

FIG. 1 also illustrates the dimensional aspects of embodiments of the current disclosure with respect to the "length" of the folding tool 100 being the longest dimension corresponding to unfolded and extended configurations of the folding tool, the "width" being the cross-sectional dimension from the right side to the left side (or from top to bottom as per perspective shown in FIG. 1(*a*)), and the "thickness" being the cross-sectional dimension from the top surface to the bottom surface, or thickness of the first and second panel components 102 and 106, which are preferentially of similar dimension and thickness with respect to one another, as shown in FIG. 1(*b*). In the various embodiments of the current disclosure, the folding tool 100 can have any desired combination of length, width and thickness dimensions, although preferred dimensions are selected by consideration of the corresponding lengths and widths of the various sheet material(s) desired to be collected onto the folding tool 100, some non-limiting examples provided herein below.

In general, embodiments of the current disclosure have flexible hinge sections with widths less than or equal to the width of the respective first and second panel components, so as to provide a fairly smooth and consistent edge along both side lengths of the inventive folding tool, and to prevent fabric or sheet material from snagging or becoming deformed during the folding of the inventive folding tool, when fabric or sheet material is present.

Further, the length of the flexible hinge section is selected, based on the material of construction, to be at least sufficiently long enough to enable the first and second panel component of embodiments of the current disclosure to be folded approximately at the mid-length distance of the hinge (center point) in order to bring the two panel components into a parallel and co-planar alignment, which some suitable spacing between the respective first and second panel components to accommodate the presence of a plurality of layers or turns of fabric or sheet material loaded onto the inventive folding tool.

Further, the thickness of the flexible hinge section is selected, based on the material of construction, to be at least sufficiently thick to provide a strong connection between the first and second panel components, yet capable of being flexible from an angle of about 0 (zero) degrees to 360 (full circle, or from a first flat position to a second flat position)

degrees, or at least from an angle of about 0 degrees to 180 (from flat to folded position), in order to enable embodiments of the current disclosure to be folded approximately at the mid-length distance of the hinge (center point) in order to bring the two panel components into a parallel and co-planar alignment. In some embodiments of the current disclosure, it is desirable to have the length and thickness of the flexible hinge section selected so as to provide a means for folding the inventive folding tool in half about the center flexible hinge section while preventing twisting or side-ways deformation of the hinge out of a plane parallel to that of the first and second panel component while the inventive folding tool is being folded or repositioned between an extended and folded configuration.

Figure 2:
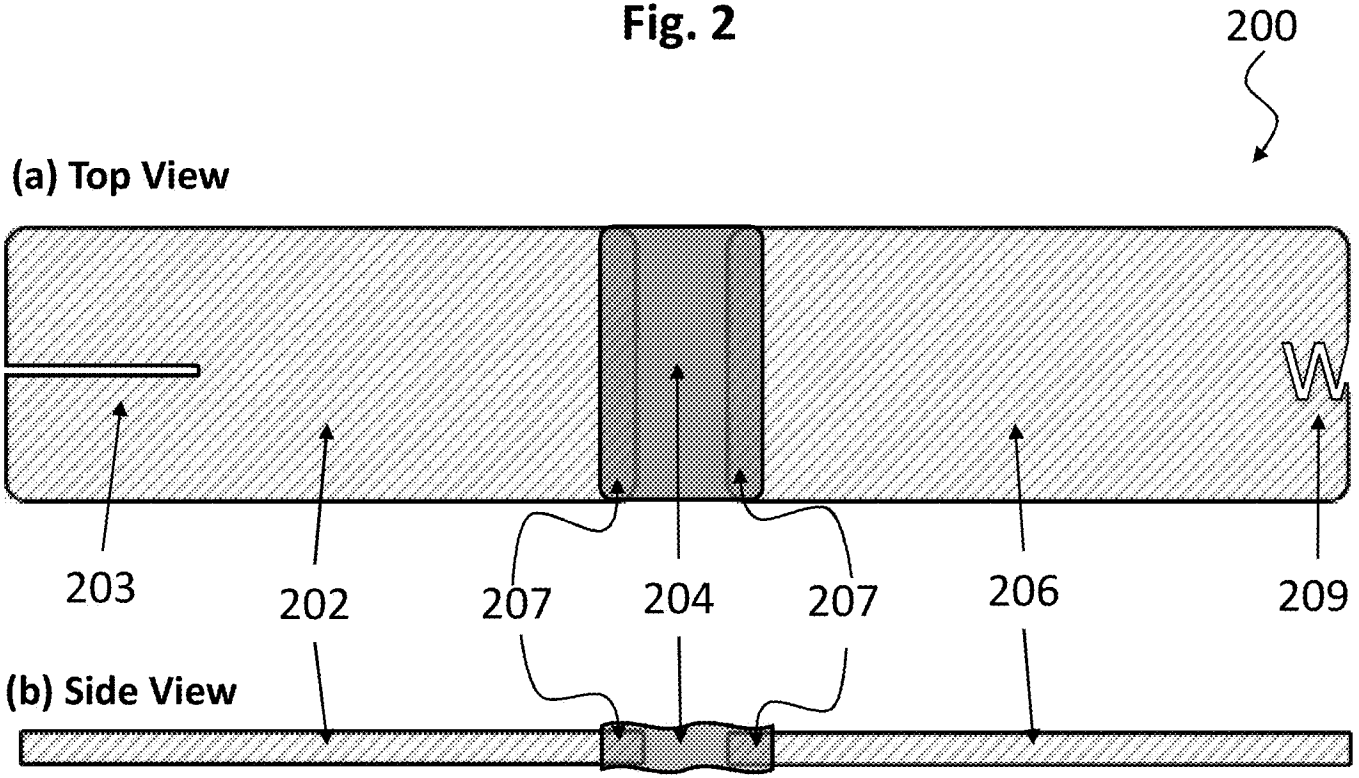
FIG. 2 shows an embodiment of the current disclosure featuring a folding tool with a flexible hinge region featuring two panel-to-hinge junctions.

FIG. 2 illustrates another embodiment of a folding tool 200 according to the current disclosure, in which a first panel component 202 is joined to a second panel component 206 by means of a flexible hinge 204, which utilizes two panel-to-hinge junctions 207, on either side of the flexible hinge 204 to connect 204 to each panel component. In this embodiment, the flexible hinge 204 is approximately the width of either the first or second panel component 202 or 206, and of sufficient length with respect to its dimensional size or length from a first panel-to-hinge junction 207 with the first panel component 202 and the second panel-to-hinge junction 207 with the second panel component 206 so as to enable the flexible hinge 204 to bend sufficiently so as to fold upon itself so that the two panel components 202 and 206 are essentially parallel and co-planar in orientation to one another. In this embodiment of the current disclosure, the flexible hinge 204 is bonded or connected to the first and second panel components 202 and 206 by some suitable means capable of fastening the components together in a fixed and irreversible manner, such bonding or connection means including adhesive, cement, glue, chemical bonding, heat bonding, crimping, heat fusion, thermal bonding, or by use of other similar materials or processes capable of forming a plurality of panel-to-panel junctions 207 that are fixed and irreversible, but which means does not interfere with the ability of the flexible hinge 204 to fold upon itself and thereby allow the extended folding tool 200 to be folded upon itself, with or without sheet material being present on the folding tool 200.

Additional embodiments of the current disclosure include the additional feature of a slit or similar cutout in one or both of the panel components to provide a means for the leading edge, corner or side of a sheet material to be tucked into or threaded into the slit in order to hold the sheet material in place and in alignment as it is folded or rolled over the inventive folding tool. One example embodiment is shown if FIG. 2, featuring a slit cutout 203 that passes completely through the cross-sectional thickness of the first panel component 202 and is oriented longitudinally and terminates at the extreme outer edge of the panel component 202 in order to facilitate the introduction of a leading edge or corner of the sheet material into and through the slit, at least partially, to hold the sheet material in place. In an alternative embodiment, a zig-zag cutout 209 can also be employed to tuck the leading edge, corner or side of a sheet material that is passed through the zig-zag slit, at least partially, to hold the sheet material in place. Naturally, in related embodiments of the current disclosure, the folding tool can have one or a plurality of slits cutouts, zig-zag cutouts and the like, located on either one or both of the first and second panel components, and optionally located along any exterior edge or side of said first and second panel components. In related embodiments, the slit cutouts can be in the form of other patterns besides a straight line, including, but not limited to cutout shapes such as hooks, elbows, U's, V's, T's, X's, and such slit cutout shapes can be of any suitable size as need to enable either a binding aid including, but not limited to a band, string, thread; or a sheet fabric to pass through the cutout shape in whole or at least partially in order to secure the binding aid or sheet fabric, respectively, to embodiments of said inventive folding tool. In additional embodiments of the current disclosure, the slit cutout 203 and zig-zag cutout 209 can also be of any desired size, length and dimension as suitable to receive a selected binding aid or sheet fabric for the purpose of securing it to at least one panel component.

Figure 3:
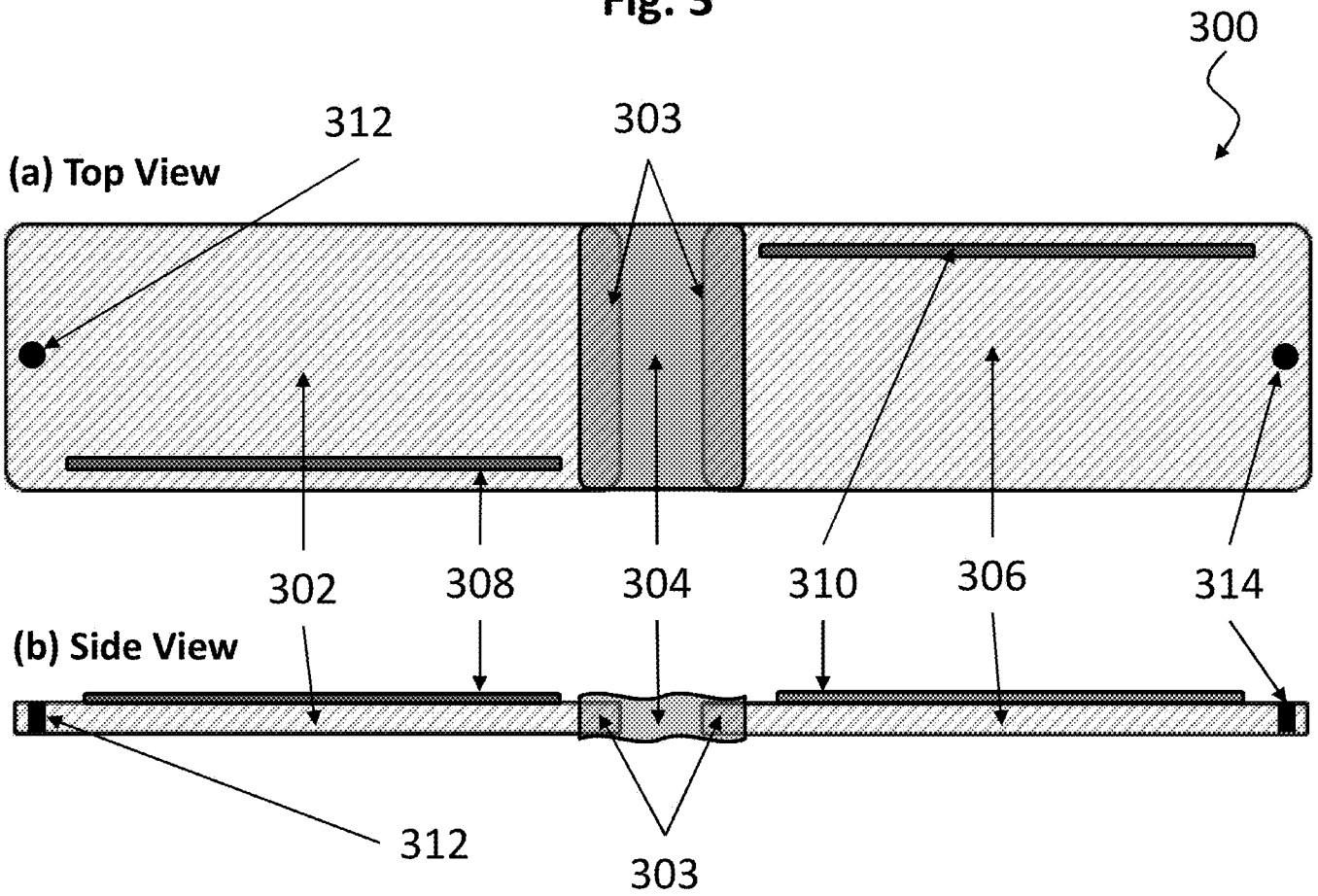
FIG. 3 shows an embodiment of the current disclosure featuring a folding tool with a flexible hinge region featuring two panel-to-hinge junctions and anti-slip elements.

FIG. 3 shows an embodiment of the current disclosure featuring a folding tool 300 with a flexible hinge 304 featuring two panel-to-hinge junctions 303, and a plurality of anti-slip elements, at least one first anti-slip element 308 located on the first panel component 302 and optionally, a second anti-slip element 310 located on the second panel component 310. The function of the anti-slip elements is to provide some friction between the panel component on which it is present and the sheet material to be loaded onto the folding tool, so that the sheet material can be folded onto the inventive device while maintaining the relative position of the sheet material in an aligned manner (i.e. keeping the leading edge substantially parallel and uniformly spaced with respect to a parallel meridian line running along the extended length of the folding tool, so that the outer edges of the sheet material approximately align as the sheet material is layered further on top of preceding layers of the sheet material as the entire quantity of the material is folded and rolled around the folding tool.

In alternative embodiments of the present disclosure, the folding tool 300 can have a single anti-slip element 308 located on just one panel, for example the first panel component 302. In other embodiments, the folding tool 300 can have two or a plurality of anti-slip elements 310 located on the same panel or on the second panel component 306 of the folding tool 300. In further embodiments, the anti-slip elements can be located on the same face of the corresponding surfaces of the folding tool 300, (i.e. located on the top surface of each panel component) as shown in FIG. 3(*a*), or alternatively, the anti-slip elements can be located on opposing faces of the corresponding surfaces of the folding tool 300 (not shown). Further, the orientation, shape and size of the anti-slip element 308 can take on any reasonable size and pattern, can be continuous or discontinuous. Examples include anti-slip elements in the forms of raised dots, raised bars, raised squares, raised chevrons, raised lines and raised patterns of a suitable anti-slip material formed onto or attached to the surface of at least one panel component of the current disclosure. In yet further embodiments, the anti-slip element can be located on the sides or edges of either or both the first and second panel components, in any form as described herein, i.e. continuous or discontinuous, and in any shape or pattern sufficient to provide at least some degree of friction to prevent slipping of the sheet textile materials while the latter is being rolled or collected onto an embodiment of the current disclosure.

Examples of suitable materials for an anti-slip element include common antiskid tapes, friction tapes, sandpaper, textured tapes and laminates, tacky silicone resins, sticky polymers, and similar materials that may be irreversibly attached to one or more surfaces of one or both of the panel components to form an augmented panel component, for the purpose of reversibly adhering to or increasing the friction between the augmented panel component and the desired sheet material. Further examples of suitable materials for an anti-slip element include patterned elements which protrude at least slightly above the plane of the panel component surface and whose patterns, including for example, checking, divots, striations, castellation's, surface roughness, cross-hatching and the like that provide sufficient roughness to create some frictional force with respect to the sheet material, without damaging the sheet material or its surfaces or finishes thereon.

In further embodiments of the current disclosure, FIGS. 3(*a*) and (*b*) show an optional magnetic clasp system composed of a first magnetic clasp 312 and a second magnetic clasp 314, either one of which could be a magnetic element with a North and South facing magnetic pole aligned perpendicular or out of the plane of the panel component's surface, with the North (N) and South (S) poles of the first magnetic clasp 312 and the second magnetic clasp 314 reversed with respect to one another, so that upon folding of the folding tool 300 with two magnetic clasps present, the magnets are aligned in an attractive fashion either with N-S poles positioned adjacently, or S-N poles positioned adjacently, depending on whether the folding tool 300 is folded upon itself either by folding out of the original plane (outwards and upwards) as shown in FIGS. 3(*a*) and (*b*) respectively, or folded into the plane (backwards and downwards).

In an alternative embodiment of the current disclosure, only one of the magnetic clasp elements is magnetic in nature, a second paired or matching magnetic clasp element being metallic and attracted to a magnet, but not magnetic itself, such as for example, but not limited to iron, steel, and related ferrous materials and ferromagnetic alloys. Further embodiments of the current disclosure can employ multiple magnetic clasps, being matched magnets or combinations of magnets and metallic elements that are attracted to one another by the magnetic force of the magnetic component. The disclosed embodiments employing only one magnet for each set of first and second magnetic clasps has the advantage of not requiring any particular alignment of the magnetic poles to ensure attraction between the said set of magnetic clasps regardless of the manner of closing or folding the various embodiments of the folding tool. The advantages of a magnetic clasp system as disclosed herein, is the ability of the magnets to hold embodiments of the folding tool in a closed or folded position, when empty of sheet material, as well as when loaded with sheet material, owing to the attractive forces of the magnetic clasp system which will always tend to attract and draw aligned pairs of the magnetic clasp system elements together. The only requirement for positioning the magnetic clasps is to position and orientate them in pairs so that upon folding of the folding tool from an extended to a folded or collapsed position, that the two components of the magnetic clasp system (i.e., a first and second magnetic clasp) are co-aligned with respect to one another so that they are attracted together and will approach each other to the extent possible as permitted by the amount of sheet material present on the inventive folding tool. Accordingly, when inventive embodiments of the folding tool are free of sheet material, the first and second panel components can readily be folding over by means of the flexible hinge so that a first and second magnetic clasp present on the respective panel components can interact, attract one another and be brought into contact due to the magnetic attractive forces, enabling the folding tool to be stored in a stable collapsed or folded orientation, reversible by overcoming the attractive forces of the at least one magnetic element of the disclosed magnetic clasp system to decouple the magnets or magnetic clasp and enable the folding tool to be opened from a closed and folded position to an open and extended orientation.

Figure 4:
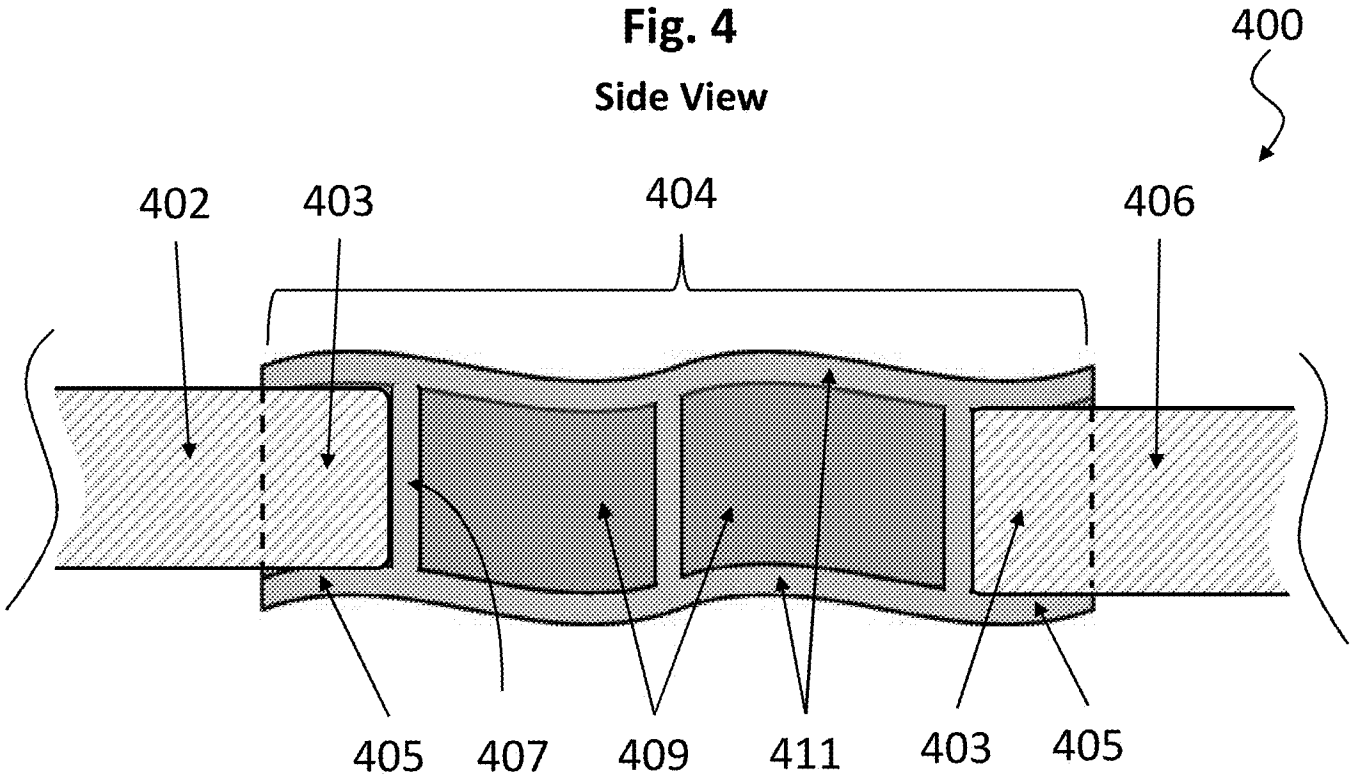
FIG. 4 shows an embodiment of the current disclosure featuring a detailed cross-sectional side view of a folding tool with a flexible hinge region featuring a pocket-like structure.

FIG. 4 shows an embodiment of the current disclosure featuring a detailed cross-sectional side view of a folding tool 400 with a flexible hinge 404 featuring a pocket-like structure or hinge connection pocket 405 that couples with a panel-to-hinge connection section 402 of a first panel component 402. The presence of the hinge connection pocket 405 provides an improved attachment means for joining the flexible hinge 404 to the plurality of panel components, by enabling greater contact between the two elements for greater adhesion and bonding surfaces, optionally augmented by means of an adhesive, bonding agent, glue or other bonding process capable of attaching the respective panel component and flexible hinge together in a durable and permanent manner, without interfering with the ability of the flexible hinge to fold over onto itself when desired. In FIG. 4, the opposite side of the flexible hinge 404 features a second panel-to-hinge section 403 of the second panel component 406 that engages with a second hinge connection pocket 405. In other embodiments, the flexible hinge 404 of the folding tool 400 can be a honeycombed structure that provides strength yet flexibility sufficient to bend upon itself, and may feature one or a plurality of interior hinge regions 409 defined by at least two or a plurality of hinge pocket walls 407 and at least one interior hinge region 409. In further embodiments of the current disclosure, the flexible hinge 404 comprises a plurality of two or more interior hinge regions 409, which may be empty (hollow or air-filled) or filled with another material. Preferentially, the interior hinge regions 409 of these embodiments are empty, providing for a lighter weight structure with flexibility. Preferentially, the interior hinge regions of these embodiments are patterned in the form of a honeycomb with interior hinge regions 409 in the form of regular, similar sized, complementary fitting unit cells, including cells that are triangular, square, pentagonal and hexagonal in cross-section, and combinations thereof that form a close-fitting repeated periodicity of cells separated by a plurality of hinge inner walls 413 that define each repeated cell and shared walls between adjacent cells. A commercial example of a suitable material is a formed sheet of surface laminated HexWeb® honeycomb material available from the Hexcell Corporation, 281 Tresser Boulevard, Stamford, Conn. 06901-3261, USA.

Figure 5:
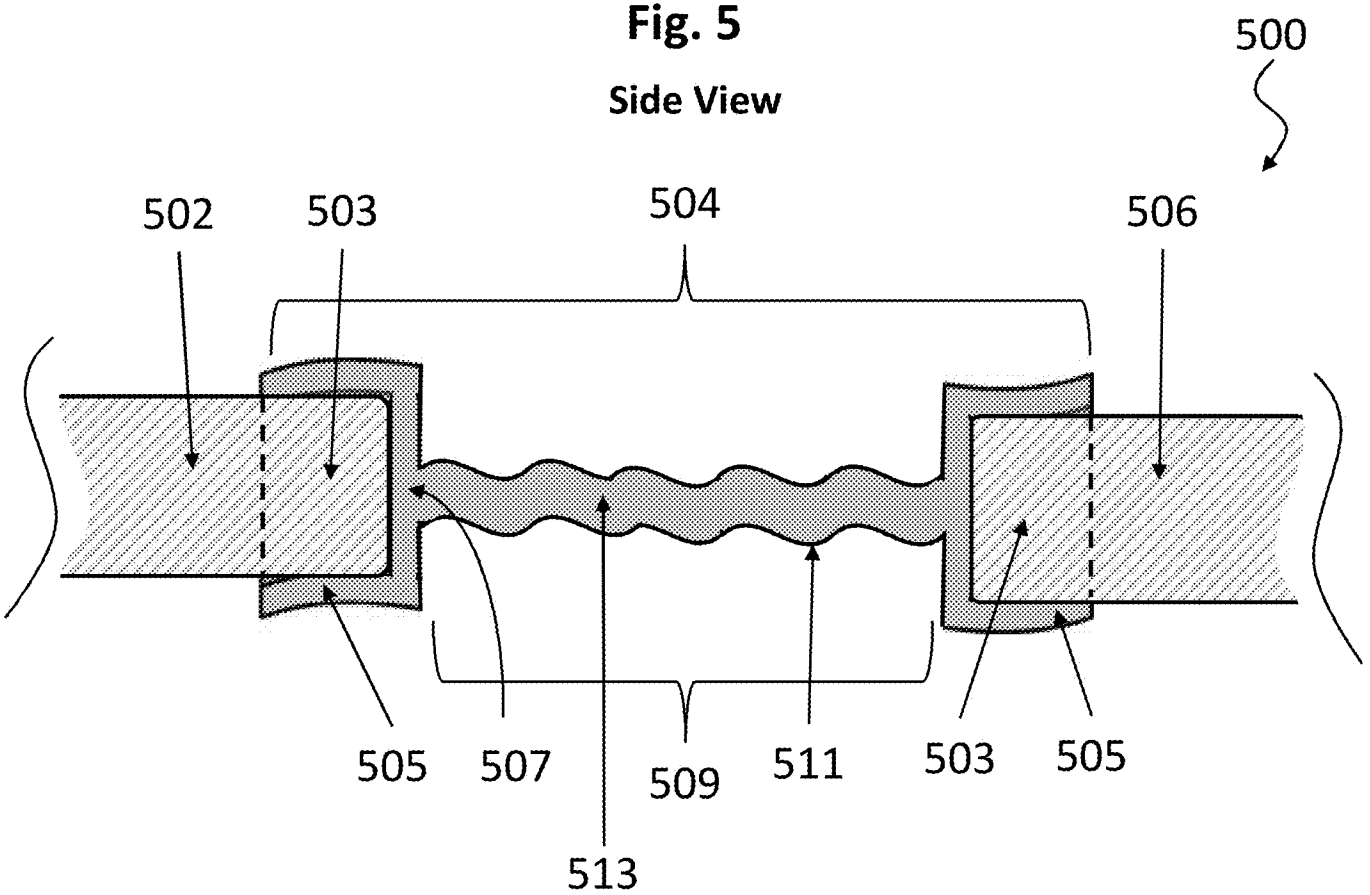
FIG. 5 shows an embodiment of the current disclosure featuring a detailed cross-sectional side view of a folding tool with a flexible hinge region featuring an articulable section.

FIG. 5 shows an embodiment of the current disclosure featuring a detailed cross-sectional side view of a folding tool 500 with a flexible hinge component 504 that features a plurality of hinge connection pockets 505 and a plurality of hinge pocket walls 507, the latter two connected to each other by means of a flexible section 513. In FIG. 5 an "I" shaped or I-style hinge is exampled, while in related embodiments other cross-sectional shapes such as a H-Style or h-style in which the flexible section 513 is either attached approximately to the respective centers of the hinge pocket walls 507 as shown in this figure, or are attached to one edge (such as the top) of the respective hinge pocket walls 507 (not shown). Commercially available flexible hinges suitable for use with and the construction of embodiments of the folding tool of the current disclosure are obtainable from a number of retailers, including, but not limited to, panel hinges made from flexible PVC (polyvinylchloride) from Profile Plastics (1226 Prospect Ave SW, Canton, Ohio 44706); standard H-Style and I-Style hinges made from flexible acrylic polymer, including but not limited to model numbers 1106578-3, 1106578-6, 1106440-6 and 1106442-6 from San Diego Plastics (2220 McKinley Avenue, National City, Calif. 91950); and living hinges constructed from flexible polyester elastomer hinge centers with outer rigid vinyl pocket channels from ABC Plastics (9132 De Soto Avenue, Chatsworth, Calif. 91311).

In related embodiments with various hinge configurations as exampled above, the articulable region 513 can be of any desired length, providing that the length is sufficient so as to enable the respective first and second panel components 502 and 506 to be repositioned from the orientation as shown in FIG. 5 to a folded configuration (not shown) in which the two panels are brought into a parallel and coplanar position by means of the flexible hinge component 504 being capable of bending over at least 180 degrees on itself to bring the folding tool 500 from an extended to a compact, folded orientation by bending the flexible section 513 in either relative direction with respect to the plane of the first panel component 502, and the reverse operation of unfolding the compact, folded folding tool 500 to an extended position.

Figure 6:
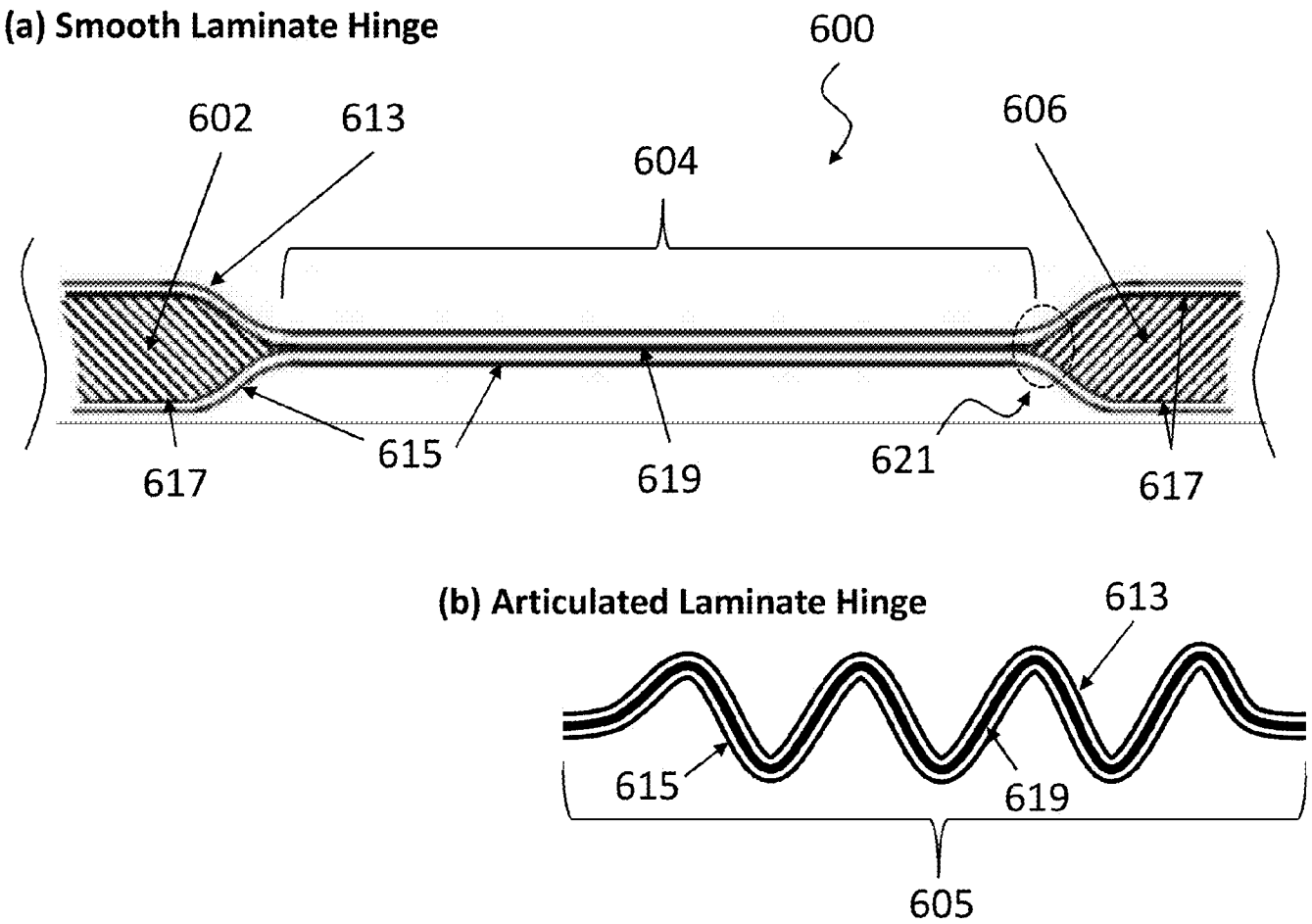
FIG. 6 shows an embodiment of the current disclosure featuring a detailed cross-sectional side view of a folding tool with a flexible hinge region featuring (a) smooth and (b) articulated laminate-style hinges.

FIG. 6 shows an embodiment of the current disclosure featuring a detailed cross-sectional side view of a folding tool 600 with a flexible hinge region 604 formed by means of a dual laminate featuring in FIG. 6(*a*) a smooth flexible hinge region 604 and in FIG. 6(*b*) an articulated hinge region 605. In this embodiment, the inventive folding tool 600 features a first panel component 602 and a second panel component 606 that are co-laminated together as shown in FIG. 6 with a first laminate layer 613 bonded to one common side of the two respective panel components 602 and 606 by means of a laminate-to-panel joinder region 617 and with a second laminate layer 615 bonded to the common opposite or opposed side of the said two panel components by means of a laminate-to-panel joinder region 617, with a gap between said panels in which the first laminate layer 613 and the second laminate layer 615 are bonded to one another by means of a laminate-to-laminate joinder region 619 without any intervening panel component in between said laminate layers 613 and 615, defining a flexible hinge region 604. In related embodiments of the current disclosure, means to form a laminate-to-panel joinder region 617 and a laminate-to-laminate region 619 include the use of, but not limited to, an adhesive, binding agent, glue, compression, heat, tacking, welding and similar materials and process used alone or in combination to form a strong, irreversible laminate layer on both sides of each of the panel components and to form the two laminate layers forming the flexible hinge region. In these embodiments of the current disclosure, the laminate material and the thickness of the laminate material are selected so as to have sufficient flexibility when formed into the bilayer hinge region as exampled by the smooth flexible hinge region 604 shown in FIG. 6.

In a related embodiment, FIG. 6(*b*) shows an articulated hinge region 605 as an alternative embodiment to the "smooth" or "flat" flexible hinge region 604 illustrated in FIG. 6(*a*). The articulated hinge region 605 also features a first laminate layer 613 joined to a second laminate layer 615 by means of a laminate-to-laminate joinder region 619, being formed in such a manner to have at least one or a plurality of non-planar regions or areas along the span of the hinge region that extend outside the plane of the hinge region 605, the regions or areas being defined by, but not limited to, accordion bends, bends, folds, V-bends, sinusoidal curves (as shown in FIG. 6(*b*)), and the like, which function to provide increased flexibility to the articulated hinge region 605 and which optionally also promote the folding operation of the folding tool 600 to fold over upon itself by folding at the articulated hinge region 605 without binding or creasing and while maintaining the first and second panel components 602 and 606 in a substantially coplanar and parallel configuration when folded.

Figure 7:
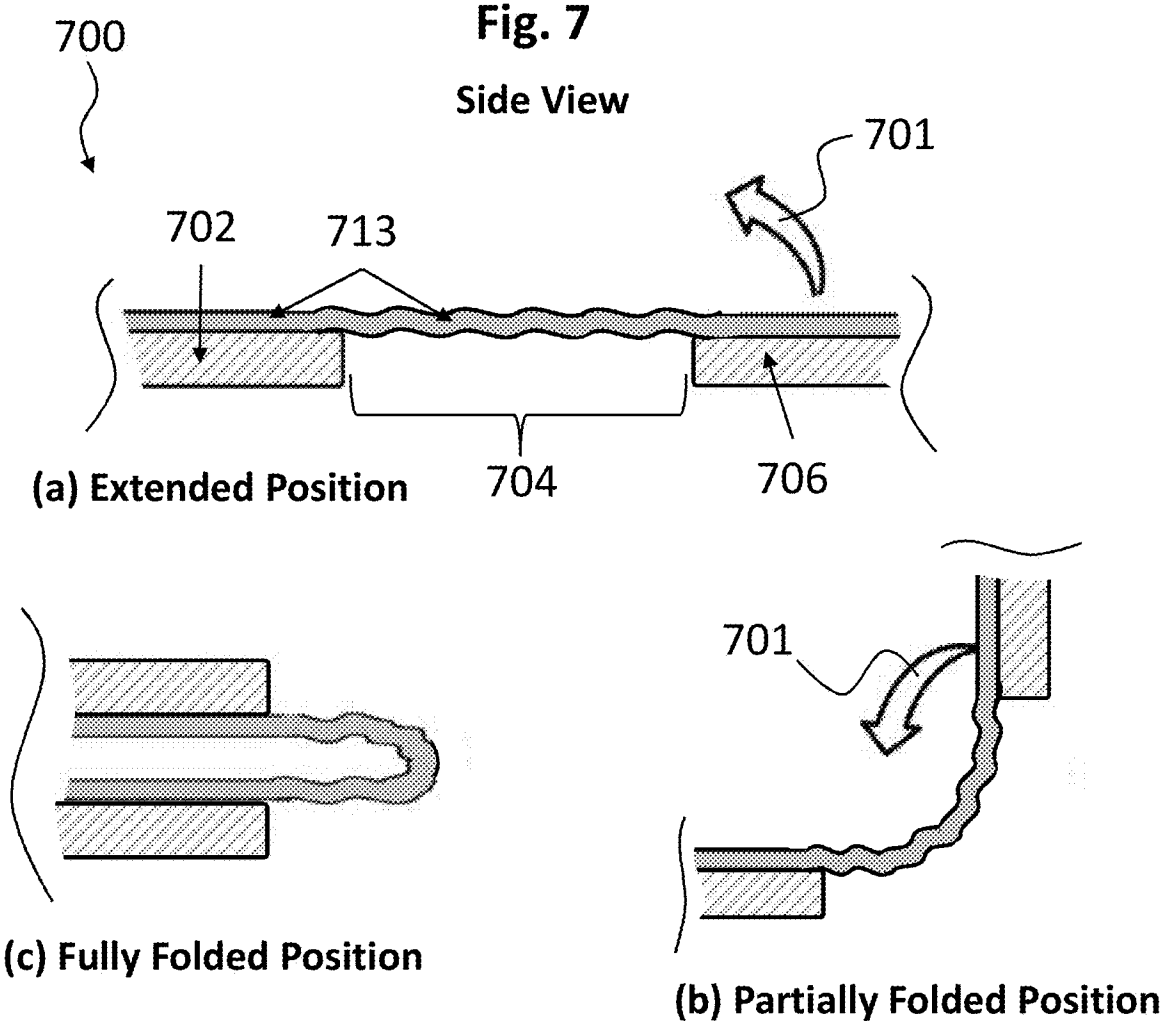
FIG. 7 shows an embodiment of the current disclosure featuring a detailed cross-sectional side view of a folding tool with a flexible hinge region being a laminate layer, in a series of positions from (a) extended to (b) partially folded to (c) fully folded.

FIG. 7 shows an embodiment of the current disclosure featuring a detailed cross-sectional side view of a folding tool 700 with a flexible hinge region 704 being manipulated through a series of positions from an initial (a) extended position to (b) a partially folded position, and then to a (c) fully folded, compact and collapsed position, as the second panel component 706 is repositioned by moving in an out of plane direction of folding 701 (FIG. 7(*a*)) to an intermediate 90° angle (FIG. 7(*b*)) and then finally to a 180° angle (FIG. 7(*c*)) with respect to the initial plane of the extended folding tool 700 prior to initiating the folding steps.

In related methods to this embodiment, the folding tool 700 can alternatively be manipulated by folding the second panel component 706 in the opposite direction to that shown as the direction of folding 701 in FIGS. 7(*a*) and (*b*). Naturally, the folding operation is not limited to either of these disclosed methods, which are described herein holding the first panel component 702 in a fixed position merely for the purpose of illustration and consistency in describing the direction of the second panel component 706 with respect to the position of the first panel component 702 during a folding operation. Further, the folding operation can be performed when the folding tool 700 has sheet fabric present as well, and as above, can alternatively be folded in the opposite direction as illustrated as well.

Figure 8:
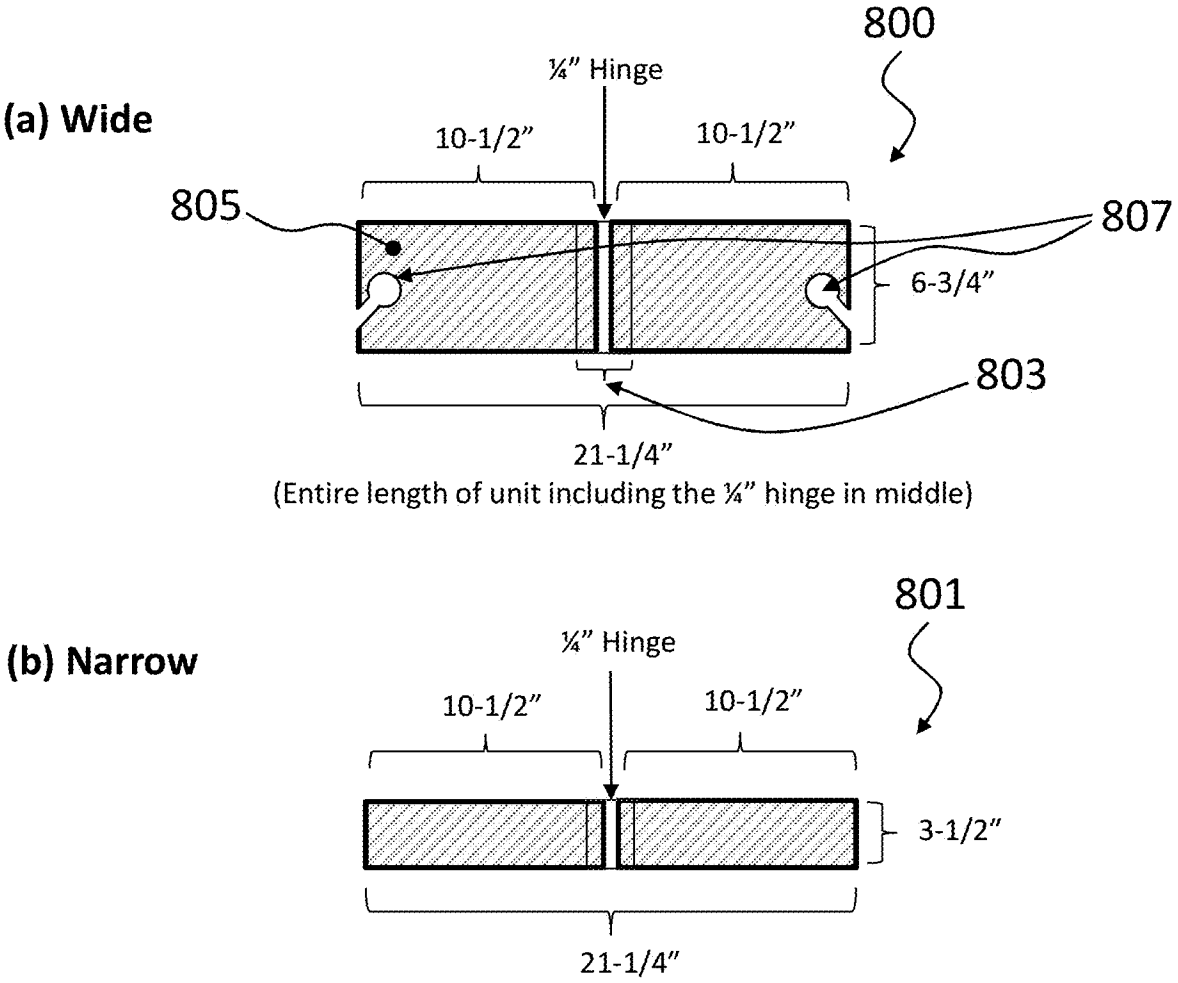
FIG. 8 shows embodiments of the current disclosure featuring a commercial sized folding tool with relatively narrow-sized hinge regions in both (a) wide or (b) narrow widths with respect to tool length.

FIG. 8 shows some preferred sizes for selected embodiments of the current disclosure featuring two commercial sized folding tools with relatively narrow-sized hinge regions of about ¼" cross sectional lengths and with panel components and hinge regions both having either a (a) wide 6¾" width (folding tool 800) or a (b) narrow 3½" width (folding tool 801) with respect to the embodied folding tool length of about 21¼". In these embodiments, the folding tools 800 and 801 feature panel components that are constructed of BCW acid free comic book cardboard panels 805 that have been partially co-laminated on both surfaces of a first and second panel component in the region of the folding hinge 803, leaving a ¼" hinge section of dual laminate structure as described herein between the two nearest edges of the two panel components, providing a flexible hinge region in these embodiments of the current disclosure as shown in FIG. 8. Embodiments of the current disclosure as shown in FIG. 8 are suitable for the collection, rolling and storage of smaller sheet materials such as fabric swatches, samples, quilt pieces and the like.

In a further embodiment of the current disclosure, FIG. 8 shows a set of two rod hanger cutouts 807 positioned at the ends, respectively, of the first and second panel components 805, said cutouts enabling this embodiment of the inventive folding tool to be hung in a flat extended position from either one of the cutouts 807 positioned to engage a closet rod, pole, wire or other similar support. Alternatively, when this particular embodiment of the inventive folding tool 800 is folded, the two rod hanger cutouts 807 come into parallel alignment, bringing the center round cutout region of the respective two cutouts 807 into an overlapping parallel alignment, enabling the folding tool 800 to engage a closet rod, pole, wire or other similar support to when in a folded configuration, regardless of whether fabric is present on the folding tool 800 or not, provided that any fabric gathered and folded onto said folding tool does not obscure either of the rod hanger cutouts 807. Needless to say, other sizes, proportions and relative ratios of lengths, widths and thicknesses of the various components of the embodiments of the current disclosure are freely selectable without limitation as required for the particular configuration for the intended use.

Figure 9:
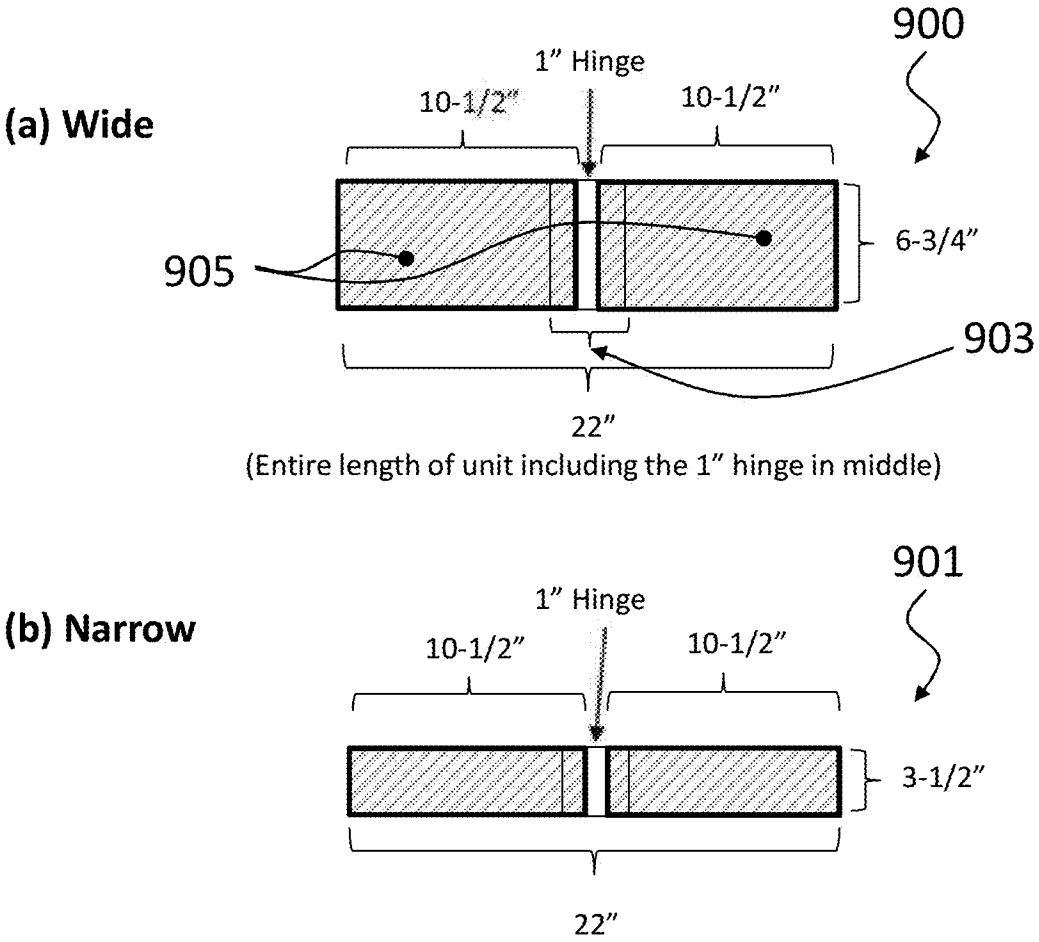
FIG. 9 shows embodiments of the current disclosure featuring a commercial sized folding tool with medium-sized hinge regions in both (a) wide or (b) narrow widths with respect to tool length.

FIG. 9 shows some additional preferred sizes for selected embodiments of the current disclosure featuring two commercial sized folding tools with medium-sized sized hinge regions of about 1" cross sectional lengths and with panel components and hinge regions both having either a (a) wide 6¾" width (folding tool 900) or a (b) narrow 3½" width (folding tool 901) with respect to the embodied folding tool length of about 22". In these embodiments, the folding tools 900 and 901 feature panel components that are constructed of polymer (polyvinylchloride) panels 905 that have been co-laminated on both surfaces of a first and second panel component in the region 903 of the folding hinge, leaving a 1" hinge section of dual laminate structure as described herein between the two nearest edges of the two panel components, providing a flexible hinge region in these embodiments of the current disclosure as shown in FIG. 9. Embodiments of the current disclosure as shown in FIG. 9 are suitable for the collection, rolling and storage of more or thicker sheet materials owing to the larger hinge which enables the folding tools 900 and 901 to hold and store either a greater amount or thicker sheet materials when folded. Accordingly, in related embodiments, the sizes of the inventive folding tool panel and hinge components can be varied and selected to have the appropriate dimensions needed for any desired application or use.

Figure 10:
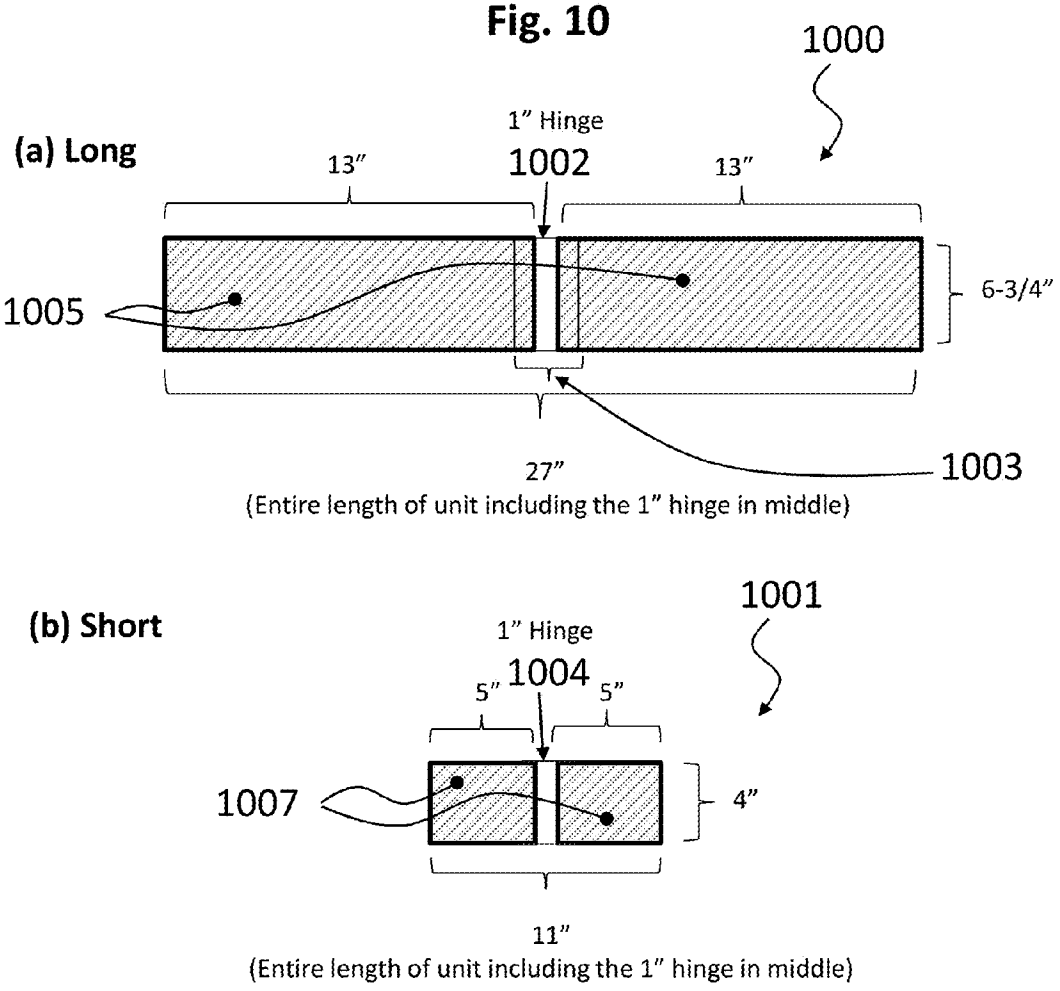
FIG. 10 shows embodiments of the current disclosure featuring a commercial sized folding tool with medium-sized hinge regions in both (a) long and (b) short length lengths featuring wide and narrow widths, respectfully, with respect to tool length.

FIG. 10 shows some additional preferred sizes for selected embodiments of the current disclosure featuring two commercial sized folding tools with medium-sized hinge regions of about 1" cross sectional lengths and with panel components and hinge regions both having either a (a) long 27" length (folding tool 1000) or a (b) short 11" length (folding tool 1001) with respect to the embodied folding tool length with corresponding widths of 6¾" and 4", respectively. In these embodiments, the folding tools 1000 and 1001 feature panel components 1005 that are constructed of compressed heavy duty paperboard sheet material that has been co-laminated on both surfaces of a first and second panel component in the region 1003 of the folding hinge, leaving a 1" hinge section 1002 of dual laminate structure as described herein between the two nearest edges of the two panel components, providing a flexible hinge region 1003 in these embodiments of the current disclosure as shown in FIG. 10(*a*). In these embodiments, the laminate is optionally applied only to the area or portions (but both sides thereof) of the two panel components 1005 within the hinge region 1003; accordingly forming a laminate-to-laminate or co-laminated hinge section 1002 between the two respective panel components 1005 as a consequence of the dual sided lamination of the two panel components 1005 that were placed in an end-to-end position as shown in FIG. 10(*a*) with an approximate 1" gap between the ends, thus forming an intermediately positioned hinged section 1002 when the two laminated sheets are applied to the respective panel components over the hinge area 1003, to the front and back of said panel components, respectively, forming a desired flexible section. Embodiments of the current disclosure as shown in FIG. 10(*a*) are suitable for the collection, rolling and storage of more or thicker sheet materials owing to the larger hinge which enables the folding tools 1000 and 1001 to hold and store either a greater amount or thicker sheet materials when folded.

In an alternative embodiment, the short folding tool 1001 illustrated in FIG. 10(*b*) shows a folding tool 1001 that features panel components 1007 that are constructed of compressed heavy duty paperboard stock material that has been fully laminated on both surfaces (front and back) of the two panels components 1007, while placed in a relative end-to-end position with a 1" spacing between them as shown in FIG. 10(*b*), so that upon lamination of the front and back of the panel components using a continuous film of laminate at least with respect to one side of the folding tool 1001 (i.e. laminate is continuous on each respective side of the tool 1001), a laminate-to-laminate or co-laminated hinge section 1004 is formed that provides for flexible bending and folding of this embodiment of folding tool 1001.

Additional Embodiments

There are additional embodiments that include features and modifications that add functionality, convenience and other advantages in making and using a folding tool according to the current disclosure.

One such embodiment includes modifying one or both terminal ends of the first panel component and, optionally, the second panel component to have a partially open hanger-shaped cutout or void region approximately resembling the form of an upper curve hook portion of a common coat hanger, thus providing a means to hang the folding tool either in an extended position using one of the hanger-shaped cutouts to hang the folding tool from a closet rod or similar support, or alternatively, providing a means to hang the folding tool in a collapsed or folded position using two of the hanger-shaped cutouts, which complement each other's shape when the folding tool is folded, forming an integrated hanger-shaped dual cutout as the shapes on each terminal end of the first and second panel component coincide upon folding to coincide to form a complementary hanger-shaped cutout which then enables the folded, collapsed folding tool to hang from a closet rod or support without coming unfolded. In such embodiments of the current disclosure, the fabric sheet(s) loaded onto the folding tool are rolled around the folding tool in a manner that does not block or obscure the optional hanger-shaped cutout region.

In a further embodiment of the disclosure, a folding tool features a plurality of hinged regions and hinges, enabling the inventive tool to be folded upon itself, either when empty or when wrapped with a textile material, to be folded at more than one location along its length, enabling the device to be folded into a more compact structure with reduced storage capacity needed, and when loaded with textile material, to be folded into a more compact or at least one dimensionally smaller size or volume enabled by a second or third hinge section and/or hinge being present with a third or higher number of panel components arranged with said additional hinges in a similar manner to that disclosed herein for a single hinge embodiment.

In another embodiment of the current disclosure, a folding tool features fastener means added to or formed into one or more of the panel components or portions thereof to enable the tucking of a corner or an edge of the sheet material into at least one or more fastener means for the purpose of aligning the sheet material and holding the sheet material in position during subsequent rolling and folding of the material onto such embodiments of the inventive folding tool. Suitable fastener means include fasteners selected from, but not limited to, clips, darts, fabric corners, pins, adhesive elements such as tacky dots and the like, magnets and ferromagnetic objects, and combinations thereof.

In another embodiment of the current disclosure, one or a plurality of magnetic or ferromagnetic fastener(s) can be used in conjunction with embodiments of the folding tool that feature a magnetic clasp as disclosed hereinabove, by positioning the fastener(s) in respectively selected and suitable positions on or within the panel components so that the fastener(s) are brought into close proximity or contact with one another for the purpose of securing the two panel components in a folded position, when the panel components are folded about the central hinge into a compact or folded unit, with or without sheet or fabric material being present on the folding tool, the magnetic attraction between the set of fasteners acting as a means to attract and hold the two panel components in a folded position.

In a related embodiment of the current disclosure, one or a plurality of magnetic or ferromagnetic fastener(s) can be used as a fastener means, by securing one or more of a first set of magnetic or ferromagnetic fasteners to one or both of the panel components, and then using a movable and/or repositionable second magnetic or ferromagnetic object, such as a second magnet or ferromagnetic (i.e. iron) object such as a disk in the approximate shape of a coin, for example, to secure the fabric materials to the panel component by securing it between the fixed first set of magnetic or ferromagnetic fasteners and the second magnet or ferromagnetic object.

In a related embodiment of the current disclosure, a logo or other such company name, trademark, design, picture or other communicative design can be embossed into, printed on or formed into one or more of the panel components of the disclosure for the purpose of advertising and identification of the goods, instructions of use, care and the like, represented graphically, textually, pictorially and combinations thereof.

Methods of Use

The various embodiments of the folding tool of the current disclosure disclosed herein are particularly suited to fold and store sheets of material with sufficient flexibility to enable them to be positioned and wrapped around the folding tool one or a plurality of times until all of the material of the sheet has been collected by rolling onto the folding tool. This can be accomplished by aligning on edge of the sheet material in a parallel configuration with respect to the length of the extended folding tool, starting with the sheet material in contact with the folding tool and aligned so that the starting edge of the sheet is parallel to a meridian line extending from one end of the tool to the other in that same longitudinal direction along the length on the extended tool. Then, the sheet material is folded over one edge of the inventive folding tool so that the folding tool then acts to gather an additional fold of the material until a first complete wrap of the fabric around the tool has been completed, and this process continued until the entire quantity of the flexible sheet has been gathered, folded about and ultimately is wrapped longitudinally around and along the length of the extended tool. At this point, embodiments of the inventive folding tool loaded with the sheet fabric can then be folded in half upon itself, securing the sheet material by means of the two opposed sides of the sheet material being forced into contact with each other as said folding tool is folded. In this configuration, sheet materials gathered onto the folding tool can be stored in a folded position and occupy a space approximately half the size (length) of the extended folding tool. This enables the folding tool embodiments of the current disclosure to be hung, provided that the length of sheet material does not block optional hanging holes present in either or both of the panel components, or alternatively for multiple loaded folding tools with various sheet materials to be stacked horizontally one on top of another, or arranged vertically one next to another like books.

One advantage of embodiments of the folding tool according to the current disclosure is the ability of the folding tool to hold the sheet material in place without unravelling or detaching from the folding tool after the sheet material has been loaded onto the folding tool when in an extended configuration and the latter has been repositioned into a folded configuration. Of course, other materials can also be wound onto and stored on the inventive tools, including thread, yarn, ribbon, bunting, edging, seam work, tapes and other craft supplies and materials.

Materials of Construction

A variety of materials are suitable for use with the various embodiments of the current disclosure as disclosed herein. With regard to the panel components, any material of suitable thickness, strength and rigidity capable of maintaining the panel in a substantially flat and planar configuration under its own weight (force of gravity) will be sufficient, including materials such as paperboard, cardstock, cardboard, foam core, plastic, polymers, honeycombed materials, metals and combinations thereof.

Suitable panel materials selected from paperboard, cardstock and cardboard can be used in their various forms including, but not limited to, single ply, multiple ply, laminated honeycombed inner ply, corrugated boards, and the like. Further, suitable panel materials can be selected from a variety of weight ranges. The International Standards Organization (ISO) provides the most consistent way to compare paper weights as it uses a measure of grams per square meter (gsm). Accordingly, panel materials can be selected from ISO paper weight ranges from about 70-100 gsm (medium textweight), or alternatively from 100-120 gsm (heavy textweight/light cardstock), or alternatively from 120-150 gsm (regular cardstock), or alternatively from 150-200 gsm (heavy cardstock), or alternatively greater than about 200 gsm (super heavy cardstock) up to about 500 gsm (heavy cardboard), and combinations thereof.

Panel materials can also be constructed from foam core materials. Suitable foam core materials include boards that have two outer laminated paper or paper board layers surrounding an inner core of a lightweight or low density foamed material, which is generally a plastic material infused with a plurality of tiny voids or bubbles that provide the final laminated structure with enhanced rigidity and strength.

Suitable paperboard and cardstock includes materials made to be acid-free or processed for archival purposes, being safe to use in scrapbooks and in contact with artwork that is intended to be kept for a long period of time. They are typically manufactured at a neutral pH level (pH 7.0) or higher, and are stable over time. They are lacking the free acids otherwise present in paper and stock materials that causes the paper to yellow and breakdown over time, a process seen by observing a very old newspaper, and which can transfer via contact to materials stored in intimate contact.

Suitable surface textures or finishes include those common to the art, selected mainly for appearance but also in light of the desired degree of adhesiveness or friction (anti-slip properties) between the panels of the current disclosure and the fabric selected for use therewith. Some examples of suitable finishes include, but are not limited to: (a) laid surfaces: machine-made paper with a pattern of parallel lines; (b) vellum: a paper finished to appear like the original writing material of the same name. It was originally made from either prepared animal skin or parchment. Vellum has various degrees of opacity, and has slightly rough finish; (c) linen: a paper finished to appear like linen; (d) felt paper that is textured by being pressed with patterned wool or felt during the manufacturing process; (e) embossed: a paper with a raised design created by pressing or hammering the design onto the back side, and (f) woven: somewhat bulky and with a slightly rough surface that results from a fine wire cloth used during the last stages of the manufacturing process.

In addition, other suitable finishes include smooth finishes, produced during rolling or extrusion. Other suitable finishes include features added, formed into or molded into the paper or cardstock during manufacture including surface embossed or imprinted patterns, lines, ridges, grooves, idents, raised dots, chevrons, dashes and the like providing at least one heightened region on the surface of the paper or cardstock. These finishes all have the effect of increasing friction between the surface of the material and a selected fabric or sheet material in order to prevent slipping or displacement while loading or unloading the sheet material.

Suitable plastics and polymers include polyacrylate, polymethacrylate, poly(alkyl)acrylates, acetobutylstyrene (ABS), Nylon (6,6), polylactic acid (PLA), polybenzimidazole, polycarbonate, polyether sulfone (PS), polyetherether ketone (PEEK), polyetherimide (PEI), polyethylene (PE), polyphenylene oxide, polyphenylene sulfide, polybutylene, polypropylene, polystyrene, polyvinyl chloride (PV), polyvinylidene chloride, perfluoropolymers (e.g. Teflon), silicones, siloxanes, polysilicones, and including copolymers thereof, co-mixtures thereof, and other thermoplastic polymers and copolymers with similar chemical and physical properties and inertness to environmental conditions including heat and humidity.

Suitable metals include castable, ductile and machinable metals, metal alloys, and metalloid materials including, but not limited to, aluminum, aluminum alloys, brass, copper, galvanized metals, ferrous alloys, iron, steel, stainless steel, tin, tin alloys, white metal, zinc, and the like.

With regard to materials of construction for the flexible hinge section employed for making embodiments of the current disclosure, suitable materials include, but are not limited to, paperboard, cardstock, cardboard, foam core, plastic, polymers, honeycombed materials and the like, configured to be relatively flexible and bendable in a perpendicular and traverse direction with respect to the cross-sectional width of the flexible hinge section, and yet simultaneously less flexible and less bendable in a side-ways or parallel direction, so that the flexible hinge section acts as a means to enable the first and second panel components to be folded about the flexible hinge section and brought into a parallel, co-planar position with respect to one another.

In some embodiments of the current disclosure, the flexible hinge section and first and second panel components may be constructed of the same material, for example, but not limited to, embodiments construction from a single polymer, in which the two panel components and hinge are formed simultaneously in a mold or extrusion process that renders the two panel components in the form of a relatively rigid and planar panel form while rending the hinge section into a relatively flexible and bendable articulated hinge section, as exampled in FIG. 5 as shown by the articulable region 509 of a flexible hinge section 513 of the embodiment shown.

Methods of Fabrication

One having skill in the art will appreciate that various embodiments of the current disclosure of a folding tool can be fabricated using a variety of materials as disclosed herein and using a variety of fabrication methods to form the respective substantially rigid panel components and the contrastingly substantially flexible hinge component of the current disclosure, including, but not limited to molding, mold-injection, extrusion, co-extrusion, machining, bonding and lamination, and combinations thereof to produce the panel and hinge components; and including, but not limited to co-forming, gluing, attaching, securing, laminating and co-laminating processes to connect the panel components and the hinge components in the desired configuration.

By means of example, one embodiment of the inventive folding tool 100 shown in FIG. 1 can be fabricated by co-extrusion of two polymeric materials, one being a more rigid, substantially inflexible polymer at the selected thickness chosen, for a high density polyethylene material being in the range for example, but not limited to, a thickness of between about 0.125 inches to about 0.5 inches; and a second polymeric material selected from a flexible, elastomeric polymer such as silicone that is very flexible at the same or similar thickness, and which are formed together in a single co-extrusion process to form the folding tool 100 as shown in FIG. 1(*a*).

In an alternative embodiment, the three components (two panel sections, and the central flexible panel (hinge) region are formed from the respective materials illustrated immediately above, but during extrusion are formed with corresponding tongue and groove details as shown in FIG. 1(*c*) that enable the three components of the inventive folding tool, a first and second panel component 102 and 106, respectively, to be joined by a common, intermediately positioned flexible hinge section 114 having tongues that enable the components to fit together in a tongue-in-groove configuration to form the folding tool embodiment shown. In this particular embodiment, the shape and sizes of the corresponding tongue and groove details are selected to enable a friction fit between the components when their respective tongue and groove portions are joined together or co-engage, resulting in a durable but non-permanent connection between the three illustrated components. In other related embodiments, the tongue and groove frictional fit can be augmented, creating a durable and permanent connection between the three illustrated components by means of an adhesive, bonding agent, cement, glue or other similar means of fixing the components together applied to the tongue, the groove and/or both, prior to or during an assembly process in which the center hinge section is secured to the two side panel components as illustrated in FIG. 1(*b*) and FIG. 1(*c*). Needless to say, the arrow shaped portion of the tongue illustrated in FIG. 1(*c*) can take on any suitable design or shape that is suitable and sufficient to enable a frictional or interference fit between one or a plurality of receptive grooves or shaped receptive regions located on the edge face of one or both panel components and the corresponding said designed or shaped tongues or protrusions on the matching edge face of at least one side of said flexible hinge section; wherein said tongues or protrusions are complementarily sized and shaped to fit within said one or plurality of receptive grooves or shaped receptive regions in order to secure said panel component to said flexible hinge section.

In other embodiments of the current disclosure, the flexible hinge section and first and second panel components may be constructed of at least one common material, selected from a laminate, film, layer, or the like, that can be applied to one or both sides of at least a portion of a first and second panel component to provide a flexible hinge section there between. A non-limiting example is shown in FIG. 6(*a*), featuring a smooth laminate hinge formed during a process of applying a suitable self-adhesive laminate film to first one side and then the second side of a first and second panel component (602 and 606) position with a space between their nearest edges (interspacing) corresponding to the length of the flexible hinge region 604 and forming said region 604 when the laminate films coincide with, and bond to one another forming a laminate-to-laminate joinder region 619, which will have the property of being relatively flexible and bendable compared to the substantially rigid panel sections.

In a related embodiment of the current disclosure, the flexible hinge section can be in the form of an articulated laminate hinge 605 as shown in FIG. 6(*b*), formed by laminating a first and second panel component on both sides, with a longer space between their nearest edges (interspacing) than that selected for a smooth laminate hinge in order to accommodate the shortening effect to the hinge's width caused during subsequent folding (articulation) of the articulated hinge section after forming the laminate-to-laminate joinder region 619. In this and related embodiments of the current disclosure, the articulated laminate hinge provides improved bending and folding characteristics and provides some elasticity (extension) properties to the hinge, enabling embodiments of the current disclosure to accommodate thicker or additional layers of textile materials when the folding tool 600(*b*) is used in a folded configuration.

One having skill in the art will appreciate that embodiments of the current disclosure as disclosed herein are useful in with sheet fabrics, textiles and accessory materials including fabrics, yarns, upholstery materials, foam sheets, laminated foams and fabrics, knits, weaves, wovens, quilts, sheets, fabric samples, rugs, swatches, swags, spreads, non-woven sheets, patterns, templates, towels, wraps, and other flat, sheet-form, bendable, flexible and foldable woven, non-woven and textile materials.

The above illustration provides many different embodiments or embodiments for implementing different features of the current disclosure. Specific embodiments of components and processes are described to help clarify the current disclosure. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the present disclosure detailing the features of the invention, as set forth in the following claims.

What is claimed is:

1. A folding device for receiving and organizing sheet materials comprising:

(a) a plurality of hingedly connected panel sections comprising a first panel component and a second panel component; wherein said first and said second panel components are substantially flat and rigid planar segments each having a length at least greater than their respective width;

(b) a central hinge section; wherein a first edge of said central hinge section is hingedly connected to a first edge of said first panel component, and wherein an opposed second edge of said central hinge section is hingedly connected to a second edge of said second panel component;

wherein said central hinge section is flexible and substantially articulable only in a traverse and perpendicular direction with respect to a longitudinal plane passing through said first and said second panel components when said first and second panel components are positioned in a substantially planar and unfolded first configuration; and wherein said central hinge section is configured to enable said first and said second panel components to be repositioned with respect to one another so as to enable their articulation between said substantially planar and unfolded first configuration to a substantially parallel and coplanar folded second configuration when folding said central hinge section upon itself in a traverse and perpendicular direction with respect to said longitudinal plane until said first and second panel components are brought into said second configuration.

2. The device of claim 1, further comprising a plurality of bore holes located near either a first distal end or a second opposed distal end of at least one of said panel components; wherein said plurality of bore holes are located near the distal ends of each of said panel components in a position selected so that at least two of the plurality of said bore holes are brought into a position of co-alignment when said folding device is positioned into a folded orientation as disclosed; and wherein said bore holes are not contiguous to any edge or end of said panel components; and wherein said first and said second distal ends of said first and said second panel components are the opposite ends of said panel components with respect to each other when said folding device is positioned into an open unfolded and flat configuration.

3. The device of claim 1, further comprising one or a plurality of cutout features wherein each cutout feature has a void space; wherein said void space has a shape selected from grooves, slits, lines, zig-zag, U-shaped, V-shaped, and W-shaped;

wherein at least one portion of said void space of said shape is contiguous with and coincidental to at least one outer side edge of at least one of said first and said second panel components; and wherein said cutout feature is configured to receive or secure a corner or segment of a flexible sheet material to a surface of a panel component bearing said cutout feature.

4. The device of claim 1, further comprising a plurality of anti-slip elements; wherein said anti-slip elements are located on at least one surface or at least one edge of at least one said panel component; wherein said anti-slip elements are selected to frictionally engage with flexible sheet material to be collected onto said device; wherein said anti-slip elements are in a form selected from raised geometric patterns, including continuous and discontinuous patterns thereof, of a suitable frictional material formed onto or attached to at least one surface or at least one edge of said at least one said panel component; and wherein said frictional material is selected from antiskid tapes, friction tapes, sandpaper, textured tapes and laminates, tacky silicone resins, sticky polymers, and combinations thereof.

5. The device of claim 1, further comprising magnetic clasp unit; wherein said magnetic clasp unit comprises a combination of at least two elements, a first element and a second element selected from a magnet, ferro-magnetic material, and iron keeper; and wherein at least one first element of said magnetic clasp unit is located on a least one front, back or intermediate surface of at least one panel component and wherein at least one second element of said magnetic clasp unit is located on a corresponding surface and at a complimentary position on said corresponding surface of said second panel component so that said first and second element of said magnetic clasp unit is brought into close proximity or contact when said device is positioned into a folded, compact configuration in which the said first and said second elements of the magnetic clasp unit become engaged magnetically.

6. The device of claim 1, further comprising one or a plurality of cutout features with a first void space comprising a slotted hole; wherein said slotted hole is contiguous with at least one panel opening located at one distal edge of said first panel component so as to provide a means for hanging said device onto a support structure selected from a rod, pole, and line, by means of passing the support structure through said panel opening then through said slotted hole to engage the support structure when said device is suspended in a vertical position from the support structure; wherein said distal edge is an edge of either of said first or said second panel component most distant from said central hinge section; wherein said device optionally comprises a second void space comprising a second slotted hole, similarly configured and correspondingly positioned at the opposite edge of said second panel component with respect to said distal edge of said first panel component so that when said device is folded from an extended planar configuration to a compact folded configuration the first and second void spaces are brought into a co-aligned and parallel orientation enabling both said first and second slotted holes to simultaneously engage the support structure; so that said device may be suspended in a vertical position from the support structure when said device is in a compact, folded configuration.

7. The device of claim 1, wherein said first and said second panel components comprise a substantially rigid material selected from paperboard, cardstock, cardboard, foam core, polymer, honeycombed material, metal and combinations thereof.

8. The device of claim 7, wherein said paperboard is selected from ISO paper weight ranges corresponding to about 70 to 500 gsm.

9. The device of claim 8, wherein said paperboard is constructed of acid-free materials suitable for extended contact with said sheet materials as disclosed herein.

10. The device of claim 7, wherein said polymer is selected from polyacrylate, polymethacrylate, poly(alkyl) acrylates, acetobutylstyrene, Nylon (6,6), polylactic acid, polybenzimidazole, polycarbonate, polyether sulfone, polyetherether ketone, polyetherimide, polyethylene, polyphenylene oxide, polyphenylene sulfide, polybutylene, polypropylene, polystyrene, polyvinyl chloride, polyvinylidene chloride, perfluoropolymers, Telfon™, silicones, siloxanes, polysilicones; and copolymers thereof; co-mixtures thereof; and other thermoplastic polymers and copolymers with similar chemical and physical properties providing inertness to environmental conditions including heat and humidity.

11. The device of claim 7, wherein at least one side of at least one of said panel components bears imprinted or printed indicia; wherein said indicia is selected from alignment marks, lines, dots, grid marks and combinations thereof.

12. The device of claim 1, wherein said central hinge section is constructed of a flexible material selected from paperboard, cardstock, cardboard, foam core, polymer, honeycombed material, metal and combinations thereof.

13. The device of claim 12, wherein said central hinge section is constructed of a common material as the material of construction of either said first or said second panel component; wherein said common material is contiguous between said central hinge section and said first and second panel components; and wherein the thickness of said common material in said central hinge section is less than the thickness of said common material in either of said first or second panel components.

14. The device of claim 12, wherein said central hinge section is constructed of a single laminate layer that overlaps at least a portion of said first and second panel components; said portion being the respective proximate ends of each panel component in contact with said central hinge section, the length of said portions of said laminate layer being sufficient to secure the laminate to said first and second panel components and thereby sufficient to secure said first and second panel components in an aligned and colinear configuration with the spacing between the respective panel components forming a single layer laminate central hinge region.

15. The device of claim 12, wherein said central hinge section is constructed of at least two opposed laminate layers that each overlap at least a portion of one side of either of said first and said second panel components, and the corresponding second side thereof; said portion being the respective proximate ends of each panel component in contact with said central hinge section, the length of said portion of said laminate layers being sufficient to secure the laminate to a first and second side of said first and said second panel components and thereby sufficient to secure said first and said second panel components in an aligned and co-linear configuration with the spacing between said first and said second panel components forming a dual layer laminate central hinge region.

16. The device of claim 1, further comprising one or a plurality of fasteners positioned on at least one surface of either said first or said second panel component; wherein said fasteners operate to reversibly secure an edge or a corner of a sheet material to assist in holding the sheet material in a fixed position relative to either said first or said second panel component; and wherein said fasteners are selected from clips, darts, fabric corners, pins, adhesive elements, magnets, ferromagnetic objects, and combinations thereof.

17. The device of claim 1, wherein said sheet materials comprise flexible materials selected from fabrics, yarns, upholstery materials, foam sheets, laminated foams, laminated fabrics, knits, weaves, woven sheet materials, quilts, bedsheets, sheets, fabric samples, rugs, swatches, swags, spreads, non-woven sheet materials, patterns, templates, towels, wraps, and combinations thereof.

18. A folding device for receiving and organizing sheet materials comprising:

(a) a plurality of hingedly connected panel sections comprising a first panel component and a second panel component; wherein said first and said second panel components are substantially flat and rigid planar segments each having a length at least greater than their respective width;

wherein said panel components have the same size with respect to width, length and thickness;

(b) a central hinge section; wherein a first edge of said central hinge section is hingedly connected to a first edge of said first panel component, and wherein an opposed second edge of said central hinge section is hingedly connected to a second edge of said second panel component; wherein said central hinge section is flexible and substantially articulable only in a traverse and perpendicular direction with respect to a longitudinal plane passing through said first and said second panel components when said first and second panel components are positioned in a substantially planar and unfolded first configuration; wherein said central hinge section is configured to enable said first and said second panel components to be repositioned with respect to one another so as to enable their articulation between said substantially planar and unfolded first configuration to a substantially parallel and coplanar folded second configuration when folding said central hinge section upon itself in a traverse and perpendicular direction with respect to said longitudinal plane until said first and second panel components are brought into said second configuration; and wherein the width of said central hinge section is less than or equal to the width of either one of said first and said second panel components.

19. A folding device for receiving and organizing sheet materials comprising:

(a) a plurality of hingedly connected panel sections comprising a first panel component and a second panel component; wherein said panel components are substantially flat and rigid planar segments each having a length at least greater than their respective width;

(b) a central hinge section; wherein said central hinge section comprises a laminated structure comprising a laminate film; wherein said laminate film is laminated to at least a portion of each of said first and said second panel components; wherein said first and said second panel components are positioned end to end in a longitudinal orientation with a space between occupied only by said laminate structure; wherein said central hinge section is flexible and substantially articulable only in a traverse and perpendicular direction with respect to a longitudinal plane passing through said first and said second panel components when said first and said second panel components are positioned in a substantially planar and unfolded first configuration; and wherein said central hinge section is configured to enable said first and said second panel components to be repositioned with respect to one another so as to enable their articulation between said substantially planar and unfolded first configuration to a substantially parallel and coplanar folded second configuration when folding said central hinge section upon itself in a traverse and perpendicular direction with respect to said longitudinal plane until said first and said second panel components are brought into said second configuration.

20. The device of claim 19, wherein said central hinge section comprises a dual laminated structure comprising a first laminate film and a second laminate film; wherein said first laminate film is laminated to a least a portion of each of said first and said second panel components; wherein said second laminate film is laminated to an opposed portion of each of said first and said second panel components; wherein said opposed portion is present on the opposite sides of both said panel components bearing said first laminate film; wherein said first and said second panel components are positioned end to end in a longitudinal orientation with a space between occupied only by said dual laminated structure; and wherein said central hinge section is dual laminated structure comprising a laminate-to-laminate joinder region without any intervening panel components in-between said first and said second laminate films.

* * * * *